US011913194B2

(12) United States Patent
Sakuta

(10) Patent No.: US 11,913,194 B2
(45) Date of Patent: Feb. 27, 2024

(54) SHOVEL

(71) Applicant: SUMITOMO CONSTRUCTION MACHINERY CO., LTD., Tokyo (JP)

(72) Inventor: Sou Sakuta, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 770 days.

(21) Appl. No.: 17/030,822

(22) Filed: Sep. 24, 2020

(65) Prior Publication Data

US 2021/0025135 A1 Jan. 28, 2021

Related U.S. Application Data

(63) Continuation of application No. PCT/JP2019/012600, filed on Mar. 25, 2019.

(30) Foreign Application Priority Data

Mar. 28, 2018 (JP) ..... 2018-062806

(51) Int. Cl.
*E02F 9/20* (2006.01)
*E02F 9/22* (2006.01)

(52) U.S. Cl.
CPC ..... *E02F 9/2033* (2013.01); *E02F 9/2246* (2013.01)

(58) Field of Classification Search
CPC ..... E02F 9/128; E02F 9/2033; E02F 9/2083; E02F 9/22; E02F 9/2235; E02F 9/2242; E02F 9/2246; E02F 9/2253; E02F 9/2282; E02F 9/24; E02F 9/262
See application file for complete search history.

(56) References Cited

U.S. PATENT DOCUMENTS 5,714,928 A * 2/1998 Sudo ..... G01S 17/931 340/904
6,292,725 B1 * 9/2001 Kageyama ..... G01S 19/49 180/169
2007/0255498 A1 * 11/2007 McDaniel ..... G01S 13/931 340/436
2013/0243557 A1 9/2013 Hiroki et al.
2015/0042259 A1 2/2015 Kim et al.
2018/0319381 A1 * 11/2018 Vitale ..... B60T 8/1755

FOREIGN PATENT DOCUMENTS

| | | |
|---|---|---|
| EP | 2716821 | 4/2014 |
| EP | 3379090 | 9/2018 |
| JP | H06-019547 | 1/1994 |
| JP | 2007-23486 | 2/2007 |
| JP | 2011-157789 | 8/2011 |
| JP | 2012-021290 | 2/2012 |
| JP | 2018-017115 | 2/2018 |
| WO | 2017/085996 | 5/2017 |

OTHER PUBLICATIONS

International Search Report for PCT/JP2019/012600 dated Jun. 25, 2019.

* cited by examiner

*Primary Examiner* — Tyler J Lee
(74) *Attorney, Agent, or Firm* — IPUSA, PLLC

(57) ABSTRACT

A shovel includes an undercarriage, an upper swing structure swingably mounted on the undercarriage, an object detector provided on the upper swing structure, and a hardware processor configured to automatically braking a drive part of the shovel according to a predetermined braking pattern, in accordance with a distance between the shovel and an object, the distance being detected by the object detector.

13 Claims, 24 Drawing Sheets

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2019/012600, filed on Mar. 25, 2019 and designating the U.S., which claims priority to Japanese patent application No. 2018-062806, filed on Mar. 28, 2018. The entire contents of the foregoing applications are incorporated herein by reference.

BACKGROUND

Technical Field

The present disclosure relates to shovels serving as excavators.

Description of Related Art

A swing work machine that automatically stops a swing motion in response to determining that there is a high possibility of contacting an object present within a monitoring area set around the swing work machine has been known.

SUMMARY

According to an aspect of the present invention, a shovel includes an undercarriage, an upper swing structure swingably mounted on the undercarriage, an object detector provided on the upper swing structure, and a hardware processor configured to automatically braking a drive part of the shovel according to a predetermined braking pattern, in accordance with a distance between the shovel and an object, the distance being detected by the object detector.

DETAILED DESCRIPTION

The related-art swing work machine as described above, however, only uniformly brakes the upper swing structure once determining to automatically stop a swing motion. Therefore, in some cases, it may be unable to automatically stop a swing motion appropriately.

Therefore, it is desirable to automatically stop a shovel more appropriately.

According to an aspect of the present invention, it is possible to automatically stop a shovel more appropriately.

Figure 1:
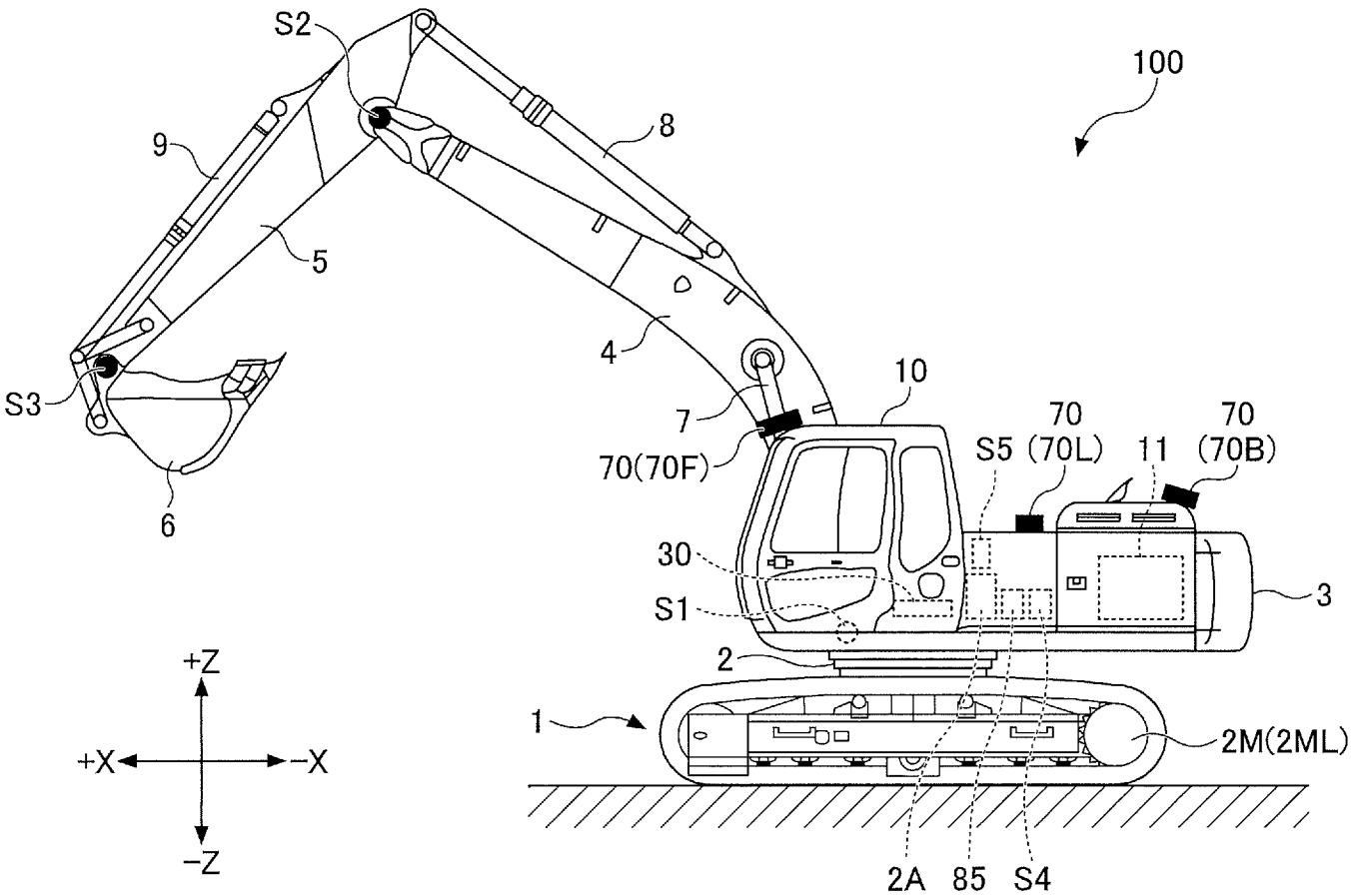
FIG. 1 is a side view of a shovel according to an embodiment of the present invention.
Figure 2:
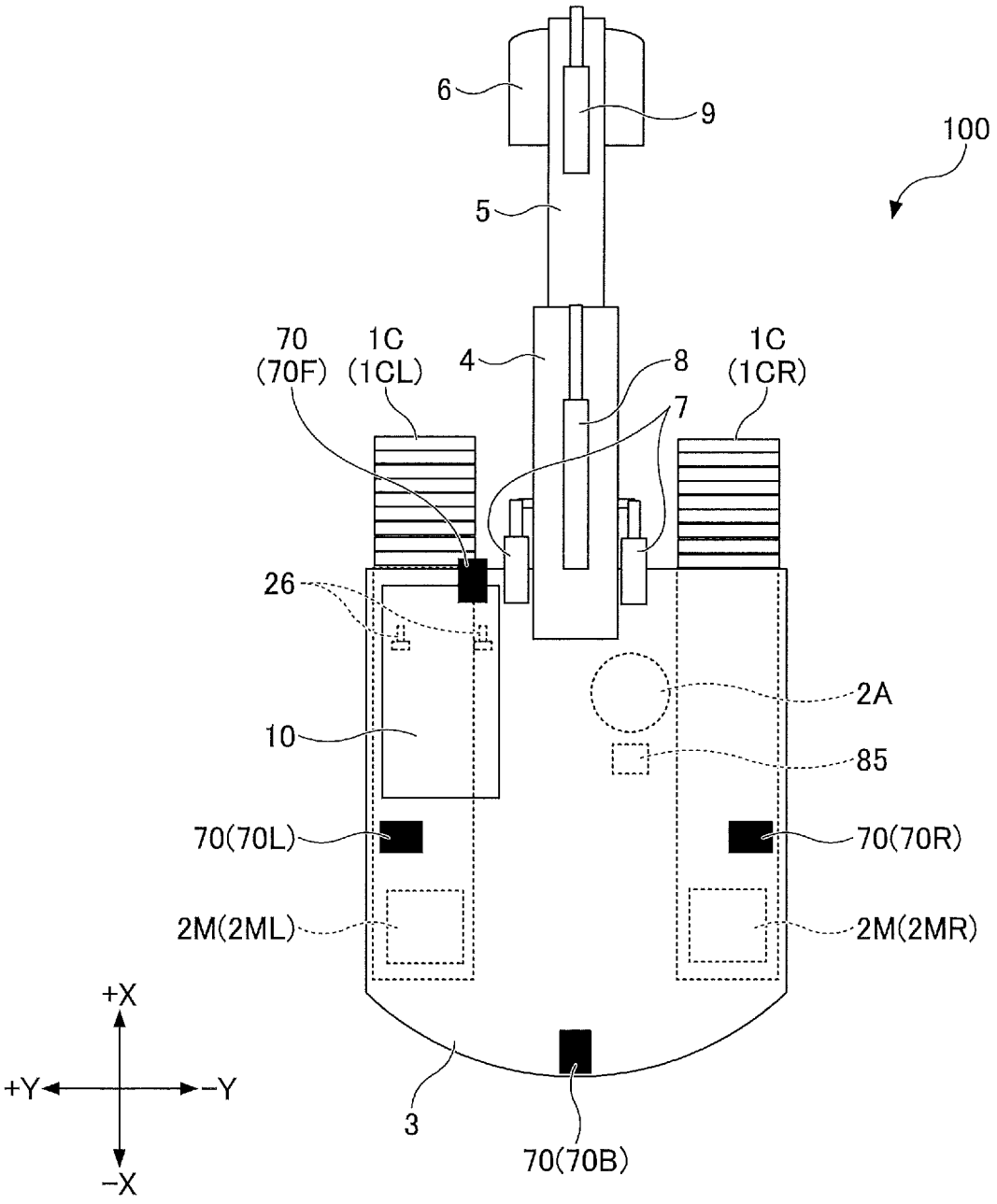
FIG. 2 is a plan view of the shovel according to the embodiment of the present invention.

First, a shovel 100 serving as an excavator according to an embodiment of the present invention is described with reference to FIGS. 1 and 2. FIG. 1 is a side view of the shovel 100. FIG. 2 is a plan view of the shovel 100.

According to this embodiment, an undercarriage 1 of the shovel 100 includes a crawler 1C serving as a driven body. The crawler 1C is driven by a travel hydraulic motor 2M mounted on the undercarriage 1. The travel hydraulic motor 2M may alternatively be a travel motor generator serving as an electric actuator. Specifically, the crawler 1C includes a left crawler 1CL and a right crawler 1CR. The left crawler 1CL is driven by a left travel hydraulic motor 2ML. The right crawler 1CR is driven by a right travel hydraulic motor 2MR. The undercarriage 1 is driven by the crawler 1C and therefore operates as a driven body.

An upper swing structure 3 is swingably mounted on the undercarriage 1 via a swing mechanism 2. The swing mechanism 2 serving as a driven body is driven by a swing hydraulic motor 2A mounted on the upper swing structure 3. The swing hydraulic motor 2A, however, may alternatively be a swing motor generator serving as an electric actuator. The upper swing structure 3 is driven by the swing mechanism 2 and therefore operates as a driven body.

A boom 4 serving as a driven body is attached to the upper swing structure 3. An arm 5 serving as a driven body is attached to the distal end of the boom 4. A bucket 6 serving as a driven body and an end attachment is attached to the distal end of the arm 5. The boom 4, the arm 5, and the bucket 6 are examples of an attachment and constitute an excavation attachment. The boom 4 is driven by a boom cylinder 7. The arm 5 is driven by an arm cylinder 8. The bucket 6 is driven by a bucket cylinder 9.

A boom angle sensor S1 is attached to the boom 4. An arm angle sensor S2 is attached to the arm 5. A bucket angle sensor S3 is attached to the bucket 6.

The boom angle sensor S1 detects the rotation angle of the boom 4. According to this embodiment, the boom angle sensor S1 is an acceleration sensor and can detect a boom angle that is the rotation angle of the boom 4 relative to the upper swing structure 3. For example, the boom angle is smallest when the boom 4 is lowest and increases as the boom 4 is raised.

The arm angle sensor S2 detects the rotation angle of the arm 5. According to this embodiment, the arm angle sensor S2 is an acceleration sensor and can detect an arm angle that is the rotation angle of the arm 5 relative to the boom 4. For example, the arm angle is smallest when the arm 5 is most closed and increases as the arm 5 is opened.

The bucket angle sensor S3 detects the rotation angle of the bucket 6. According to this embodiment, the bucket angle sensor S3 is an acceleration sensor and can detect a bucket angle that is the rotation angle of the bucket 6 relative to the arm 5. For example, the bucket angle is smallest when the bucket 6 is most closed and increases as the bucket 6 is opened.

Each of the boom angle sensor S1, the arm angle sensor S2, and the bucket angle sensor S3 may alternatively be a potentiometer using a variable resistor, a stroke sensor that detects the stroke amount of a corresponding hydraulic cylinder, a rotary encoder that detects a rotation angle about a link pin, a gyroscope, a combination of an acceleration sensor and a gyroscope, or the like.

A cabin 10 serving as a cab is provided and a power source such as an engine 11 is mounted on the upper swing structure 3. Furthermore, a controller 30, an object detector 70, an orientation detector 85, a body tilt sensor S4, a swing angular velocity sensor S5, etc., are attached to the upper swing structure 3. An operating device 26, etc., are provided in the cabin 10. In this specification, for convenience, the side of the upper swing structure 3 on which the boom 4 is attached is defined as the front, and the side of the upper swing structure 3 on which a counterweight is attached is defined as the back.

The controller 30 is a control device for controlling the shovel 100. According to this embodiment, the controller 30 is constituted of a computer including a CPU, a RAM, an NVRAM, a ROM, etc. The controller 30 reads programs corresponding to functional elements from the ROM, loads the programs into the RAM, and causes the CPU to execute corresponding processes.

The object detector 70 is an example of a surroundings monitoring device and is configured to detect an object present in an area surrounding the shovel 100. The object is, for example, a person, an animal, a vehicle, a construction machine, a building, a hole or the like. The object detector 70 is, for example, an ultrasonic sensor, a millimeter wave radar, a stereo camera, a LIDAR, a distance image sensor, an infrared sensor or the like. According to this embodiment, the object detector 70 includes a front sensor 70F attached to the front end of the upper surface of the cabin 10, a back sensor 70B attached to the back end of the upper surface of the upper swing structure 3, a left sensor 70L attached to the left end of the upper surface of the upper swing structure 3, and a right sensor 70R attached to the right end of the upper surface of the upper swing structure 3.

The object detector 70 serving as a surroundings monitoring device may also be configured to detect a predetermined object within a predetermined area set around the shovel 100. That is, the object detector 70 may be configured to be able to identify at least one of the type, position, shape, etc., of an object. For example, the object detector 70 may be configured to be able to distinguish between a person and an object other than a person. Furthermore, the object detector 70 may be configured to a distance from the object detector 70 or the shovel 100 to an identified object.

The orientation detector 85 is configured to detect information on a relative relationship between the orientation of the upper swing structure 3 and the orientation of the undercarriage 1 (hereinafter "orientation-related information"). The orientation detector 85 may be constituted of, for example, a combination of a geomagnetic sensor attached to the undercarriage 1 and a geomagnetic sensor attached to the upper swing structure 3. The orientation detector 85 may alternatively be constituted of a combination of a GNSS receiver attached to the undercarriage 1 and a GNSS receiver attached to the upper swing structure 3. In a configuration where the upper swing structure 3 is driven to swing by a swing motor generator, the orientation detector 85 may be constituted of a resolver. The orientation detector 85 may be placed at, for example, a center joint provided in relation to the swing mechanism 2 that achieves relative rotation between the undercarriage 1 and the upper swing structure 3.

The body tilt sensor S4 is configured to detect the inclination of the shovel 100 to a predetermined plane. According to this embodiment, the body tilt sensor S4 is an acceleration sensor that detects the upper swing structure 3's tilt angle about its longitudinal axis and tilt angle about its lateral axis to a horizontal plane. The body tilt sensor S4 may be constituted of a combination of an acceleration sensor and a gyroscope. For example, the longitudinal axis and the lateral axis of the upper swing structure 3 pass through the shovel center point that is a point on the swing axis of the shovel 100, crossing each other at right angles.

The swing angular velocity sensor S5 is configured to detect the swing angular velocity of the upper swing structure 3. According to this embodiment, the swing angular velocity sensor S5 is a gyroscope. The swing angular velocity sensor S5 may also be a resolver, a rotary encoder, or the like. The swing angular velocity sensor S5 may also detect swing speed. The swing speed may be calculated from swing angular velocity.

Hereinafter, any combination of the boom angle sensor S1, the arm angle sensor S2, the bucket angle sensor S3, the body tilt sensor S4, and the swing angular velocity sensor S5 is also collectively referred to as "posture sensor."

Figure 3:
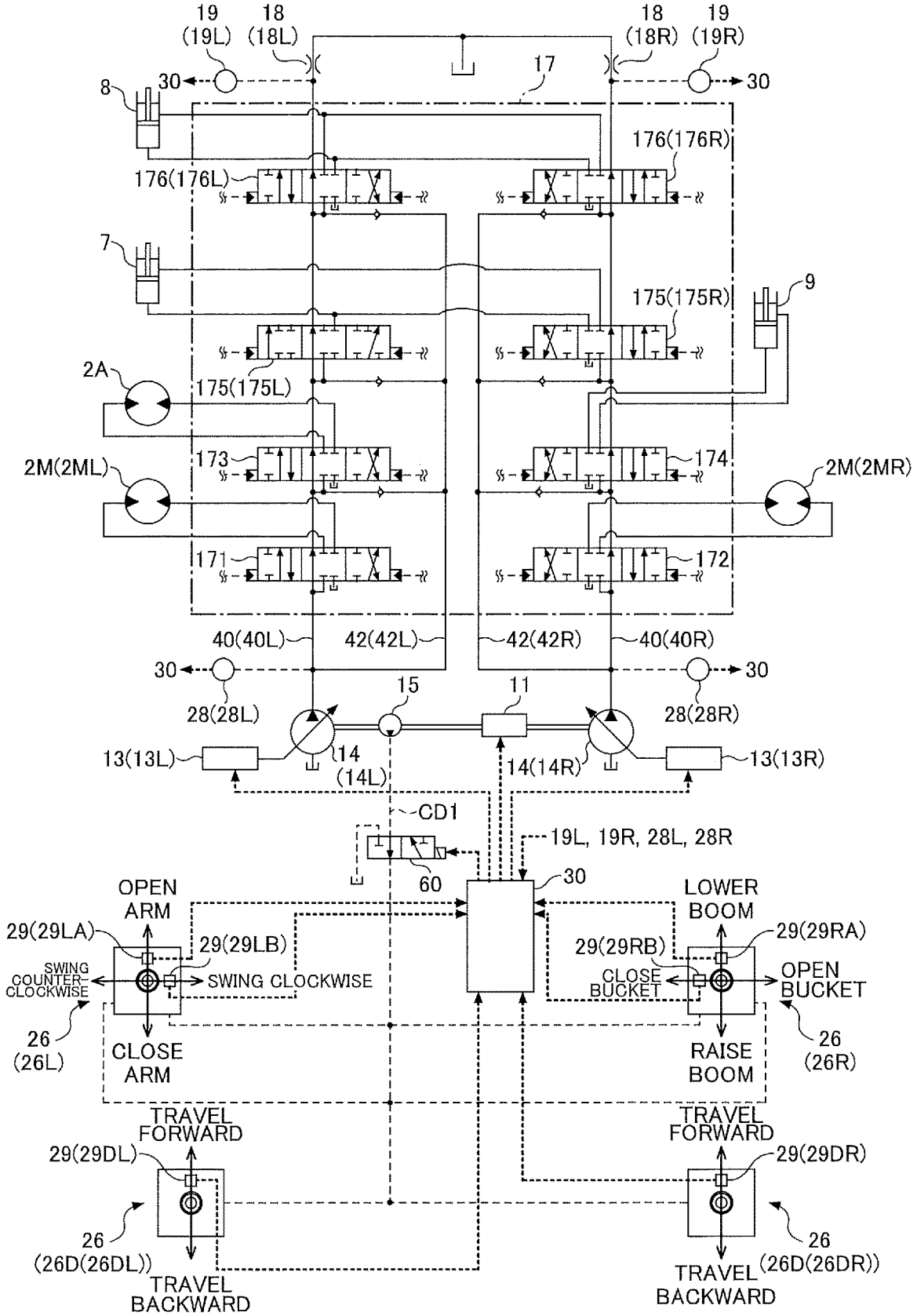
FIG. 3 is a diagram illustrating an example configuration of a hydraulic system installed in the shovel.

Next, an example configuration of a hydraulic system installed in the shovel 100 is described with reference to FIG. 3. FIG. 3 is a schematic diagram illustrating an example configuration of the hydraulic system installed in the shovel 100. In FIG. 3, a mechanical power system, a hydraulic oil line, a pilot line, and an electric control system are indicated by a double line, a solid line, a dashed line, and a dotted line, respectively.

The hydraulic system of the shovel 100 mainly includes the engine 11, a regulator 13, a main pump 14, a pilot pump 15, a control valve 17, the operating device 26, a discharge pressure sensor 28, an operating pressure sensor 29, the controller 30, and a control valve 60.

In FIG. 3, the hydraulic system circulates hydraulic oil from the main pump 14 driven by the engine 11 to a hydraulic oil tank via a center bypass conduit 40 or a parallel conduit 42.

The engine 11 is a drive source of the shovel 100. According to this embodiment, the engine 11 is, for example, a diesel engine that so operates as to maintain a predetermined rotational speed. The output shaft of the engine 11 is coupled to the respective input shafts of the main pump 14 and the pilot pump 15.

The main pump 14 is configured to supply hydraulic oil to the control valve 17 via a hydraulic oil line. According to this embodiment, the main pump 14 is a swash plate variable displacement hydraulic pump.

The regulator 13 is configured to control the discharge quantity (geometric displacement) of the main pump 14. According to this embodiment, the regulator 13 controls the discharge quantity of the main pump 14 by adjusting the swash plate tilt angle of the main pump 14 in response to a control command from the controller 30.

The pilot pump 15 is configured to supply hydraulic oil to hydraulic control devices including the operating device 26 via a pilot line. According to this embodiment, the pilot pump 15 is a fixed displacement hydraulic pump. The pilot pump 15, however, may be omitted. In this case, the function carried by the pilot pump 15 may be implemented by the main pump 14. That is, the main pump 14 may have the function of supplying hydraulic oil to the operating device 26, etc., after reducing the pressure of the hydraulic oil with a throttle or the like, apart from the function of supplying hydraulic oil to the control valve 17.

The control valve 17 is a hydraulic control device that controls the hydraulic system in the shovel 100. According to this embodiment, the control valve 17 includes control valves 171 through 176. The control valve 175 includes a control valve 175L and a control valve 175R. The control valve 176 includes a control valve 176L and a control valve 176R. The control valve 17 can selectively supply hydraulic oil discharged by the main pump 14 to one or more hydraulic actuators through the control valves 171 through 176. The control valves 171 through 176 are configured to control the flow rate of hydraulic oil flowing from the main pump 14 to hydraulic actuators and the flow rate of hydraulic oil flowing from hydraulic actuators to the hydraulic oil tank. The hydraulic actuators include the boom cylinder 7, the arm cylinder 8, the bucket cylinder 9, the left travel hydraulic motor 2ML, the right travel hydraulic motor 2MR, and the swing hydraulic motor 2A.

The operating device 26 is a device that an operator uses to operate actuators. The actuators include at least one of a hydraulic actuator and an electric actuator. According to this embodiment, the operating device 26 is configured to supply hydraulic oil discharged by the pilot pump 15 to a pilot port of a corresponding control valve in the control valve 17 via a pilot line. The pressure of hydraulic oil supplied to each pilot port (pilot pressure) is a pressure commensurate with the direction of operation and the amount of operation of a lever or pedal (not depicted) of the operating device 26 for a corresponding hydraulic actuator.

The discharge pressure sensor 28 is configured to detect the discharge pressure of the main pump 14. According to this embodiment, the discharge pressure sensor 28 outputs the detected value to the controller 30.

The operating pressure sensor 29 is configured to detect the details of the operator's operation of the operating device 26. According to this embodiment, the operating pressure sensor 29 detects the direction of operation and the amount of operation of a lever or pedal of the operating device 26 corresponding to each actuator in the form of pressure (operating pressure), and outputs the detected value to the controller 30. The operation details of the operating device 26 may be detected using a sensor other than an operating pressure sensor.

The main pump 14 includes a left main pump 14L and a right main pump 14R. The left main pump 14L is configured to circulate hydraulic oil to the hydraulic oil tank via a left center bypass conduit 40L or a left parallel conduit 42L. The right main pump 14R is configured to circulate hydraulic oil to the hydraulic oil tank via a right center bypass conduit 40R or a right parallel conduit 42R.

The left center bypass conduit 40L is a hydraulic oil line that passes through the control valves 171, 173, 175L and 176L placed in the control valve 17. The right center bypass conduit 40R is a hydraulic oil line that passes through the control valves 172, 174, 175R and 176R placed in the control valve 17.

The control valve 171 is a spool valve that switches the flow of hydraulic oil in order to supply hydraulic oil discharged by the left main pump 14L to the left travel hydraulic motor 2ML and to discharge hydraulic oil discharged by the left travel hydraulic motor 2ML to the hydraulic oil tank.

The control valve 172 is a spool valve that switches the flow of hydraulic oil in order to supply hydraulic oil discharged by the right main pump 14R to the right travel hydraulic motor 2MR and to discharge hydraulic oil discharged by the right travel hydraulic motor 2MR to the hydraulic oil tank.

The control valve 173 is a spool valve that switches the flow of hydraulic oil in order to supply hydraulic oil discharged by the left main pump 14L to the swing hydraulic motor 2A and to discharge hydraulic oil discharged by the swing hydraulic motor 2A to the hydraulic oil tank.

The control valve 174 is a spool valve that switches the flow of hydraulic oil in order to supply hydraulic oil discharged by the right main pump 14R to the bucket cylinder 9 and to discharge hydraulic oil in the bucket cylinder 9 to the hydraulic oil tank.

The control valve 175L is a spool valve that switches the flow of hydraulic oil in order to supply hydraulic oil discharged by the left main pump 14L to the boom cylinder 7. The control valve 175R is a spool valve that switches the flow of hydraulic oil in order to supply hydraulic oil discharged by the right main pump 14R to the boom cylinder 7 and to discharge hydraulic oil in the boom cylinder 7 to the hydraulic oil tank.

The control valve 176L is a spool valve that switches the flow of hydraulic oil in order to supply hydraulic oil discharged by the left main pump 14L to the arm cylinder 8 and to discharge hydraulic oil in the arm cylinder 8 to the hydraulic oil tank.

The control valve 176R is a spool valve that switches the flow of hydraulic oil in order to supply hydraulic oil discharged by the right main pump 14R to the arm cylinder 8 and to discharge hydraulic oil in the arm cylinder 8 to the hydraulic oil tank.

The left parallel conduit 42L is a hydraulic oil line parallel to the left center bypass conduit 40L. When the flow of hydraulic oil through the left center bypass conduit 40L is restricted or blocked by any of the control valves 171, 173 and 175L, the left parallel conduit 42L can supply hydraulic oil to a control valve further downstream. The right parallel conduit 42R is a hydraulic oil line parallel to the right center bypass conduit 40R. When the flow of hydraulic oil through the right center bypass conduit 40R is restricted or blocked by any of the control valves 172, 174 and 175R, the right parallel conduit 42R can supply hydraulic oil to a control valve further downstream.

The regulator 13 includes a left regulator 13L and a right regulator 13R. The left regulator 13L is configured to control the discharge quantity of the left main pump 14L by adjusting the swash plate tilt angle of the left main pump 14L in accordance with the discharge pressure of the left main pump 14L. Specifically, the left regulator 13L is configured to, for example, reduce the discharge quantity of the left main pump 14L by adjusting its swash plate tilt angle, according as the discharge pressure of the left main pump 14L increases. The same is the case with the right regulator 13R. This is for preventing the absorbed power of the main pump 14 expressed by the product of discharge pressure and discharge quantity from exceeding the output power of the engine 11.

The operating device 26 includes a left operating lever 26L, a right operating lever 26R, and a travel lever 26D. The travel lever 26D includes a left travel lever 26DL and a right travel lever 26DR.

The left operating lever 26L is used for swing operation and for operating the arm 5. When operated forward or backward (in an arm opening or closing direction), the left operating lever 26L introduces a control pressure commensurate with the amount of lever operation to a pilot port of the control valve 176, using hydraulic oil discharged by the pilot pump 15. When operated rightward or leftward (in a swing direction), the left operating lever 26L introduces a control pressure commensurate with the amount of lever operation to a pilot port of the control valve 173, using hydraulic oil discharged by the pilot pump 15.

Specifically, when operated in the arm closing direction, the left operating lever 26L introduces hydraulic oil to the right pilot port of the control valve 176L and introduces hydraulic oil to the left pilot port of the control valve 176R. Furthermore, when operated in the arm opening direction, the left operating lever 26L introduces hydraulic oil to the left pilot port of the control valve 176L and introduces hydraulic oil to the right pilot port of the control valve 176R. Furthermore, when operated in a counterclockwise swing direction, the left operating lever 26L introduces hydraulic oil to the left pilot port of the control valve 173, and when operated in a clockwise swing direction, the left operating lever 26L introduces hydraulic oil to the right pilot port of the control valve 173.

The right operating lever 26R is used to operate the boom 4 and operate the bucket 6. When operated forward or backward (in a boom lowering or raising direction), the right operating lever 26R introduces a control pressure commensurate with the amount of lever operation to a pilot port of the control valve 175, using hydraulic oil discharged by the pilot pump 15. When operated rightward or leftward (in a bucket opening or closing direction), the right operating lever 26R introduces a control pressure commensurate with the amount of lever operation to a pilot port of the control valve 174, using hydraulic oil discharged by the pilot pump 15.

Specifically, when operated in the boom lowering direction, the right operating lever 26R introduces hydraulic oil to the right pilot port of the control valve 175R. Furthermore, when operated in the boom raising direction, the right operating lever 26R introduces hydraulic oil to the right pilot port of the control valve 175L and introduces hydraulic oil to the left pilot port of the control valve 175R. When operated in the bucket closing direction, the right operating lever 26R introduces hydraulic oil to the right pilot port of the control valve 174, and when operated in the bucket opening direction, the right operating lever 26R introduces hydraulic oil to the left pilot port of the control valve 174.

The travel lever 26D is used to operate the crawler 10. Specifically, the left travel lever 26DL is used to operate the left crawler 1CL. The left travel lever 26DL may be configured to operate together with a left travel pedal. When operated forward or backward, the left travel lever 26DL introduces a control pressure commensurate with the amount of lever operation to a pilot port of the control valve 171, using hydraulic oil discharged by the pilot pump 15. The right travel lever 26DR is used to operate the right crawler 1CR. The right travel lever 26DR may be configured to operate together with a right travel pedal. When operated forward or backward, the right travel lever 26DR introduces a control pressure commensurate with the amount of lever operation to a pilot port of the control valve 172, using hydraulic oil discharged by the pilot pump 15.

The discharge pressure sensor 28 includes a discharge pressure sensor 28L and a discharge pressure sensor 28R. The discharge pressure sensor 28L detects the discharge pressure of the left main pump 14L, and outputs the detected value to the controller 30. The same is the case with the discharge pressure sensor 28R.

The operating pressure sensor 29 includes operating pressure sensors 29LA, 29LB, 29RA, 29RB, 29DL and 29DR. The operating pressure sensor 29LA detects the details of the operator's forward or backward operation of the left operating lever 26L in the form of pressure, and outputs the detected value to the controller 30. Examples of the details of operation include the direction of lever operation and the amount of lever operation (the angle of lever operation).

Likewise, the operating pressure sensor 29LB detects the details of the operator's rightward or leftward operation of the left operating lever 26L in the form of pressure, and outputs the detected value to the controller 30. The operating pressure sensor 29RA detects the details of the operator's forward or backward operation of the right operating lever 26R in the form of pressure, and outputs the detected value to the controller 30. The operating pressure sensor 29RB detects the details of the operator's rightward or leftward operation of the right operating lever 26R in the form of pressure, and outputs the detected value to the controller 30. The operating pressure sensor 29DL detects the details of the operator's forward or backward operation of the left travel lever 26DL in the form of pressure, and outputs the detected value to the controller 30. The operating pressure sensor 29DR detects the details of the operator's forward or backward operation of the right travel lever 26DR in the form of pressure, and outputs the detected value to the controller 30.

The controller 30 receives the output of the operating pressure sensor 29, and outputs a control command to the regulator 13 to change the discharge quantity of the main pump 14 on an as-needed basis.

Here, negative control using a throttle 18 and a control pressure sensor 19 is described. The throttle 18 includes a left throttle 18L and a right throttle 18R and the control pressure sensor 19 includes a left control pressure sensor 19L and a right control pressure sensor 19R.

A left throttle 18L is placed between the most downstream control valve 176L and the hydraulic oil tank in the left center bypass conduit 40L. Therefore, the flow of hydraulic oil discharged by the left main pump 14L is restricted by the left throttle 18L. The left throttle 18L generates a control pressure for controlling the left regulator 13L. The left control pressure sensor 19L is a sensor for detecting this control pressure, and outputs the detected value to the controller 30. The controller 30 controls the discharge quantity of the left main pump 14L by adjusting the swash plate tilt angle of the left main pump 14L in accordance with this control pressure. The controller 30 decreases the discharge quantity of the left main pump 14L as this control pressure increases, and increases the discharge quantity of the left main pump 14L as this control pressure decreases. The discharge quantity of the right main pump 14R is controlled in the same manner.

Specifically, as illustrated in FIG. 3, in a standby state where none of the hydraulic actuators is operated in the shovel 100, hydraulic oil discharged by the left main pump 14L arrives at the left throttle 18L through the left center bypass conduit 40L. The flow of hydraulic oil discharged by the left main pump 14L increases the control pressure generated upstream of the left throttle 18L. As a result, the controller 30 decreases the discharge quantity of the left main pump 14L to a minimum allowable discharge quantity to reduce pressure loss (pumping loss) during the passage of the discharged hydraulic oil through the left center bypass conduit 40L. In contrast, when any of the hydraulic actuators is operated, hydraulic oil discharged by the left main pump 14L flows into the operated hydraulic actuator via a control valve corresponding to the operated hydraulic actuator. The flow of hydraulic oil discharged by the left main pump 14L that arrives at the left throttle 18L is reduced in amount or lost, so that the control pressure generated upstream of the left throttle 18L is reduced. As a result, the controller 30 increases the discharge quantity of the left main pump 14L to cause sufficient hydraulic oil to flow into the operated hydraulic actuator to ensure driving of the operated hydraulic actuator. The discharge quantity of the right main pump 14R is controlled in the same manner.

According to the configuration as described above, the hydraulic system of FIG. 3 can reduce unnecessary energy consumption in the main pump 14 in the standby state. The unnecessary energy consumption includes pumping loss that hydraulic oil discharged by the main pump 14 causes in the center bypass conduit 40. Furthermore, in the case of actuating a hydraulic actuator, the hydraulic system of FIG. 3 can ensure that necessary and sufficient hydraulic oil is supplied from the main pump 14 to the hydraulic actuator to be actuated.

The control valve 60 is configured to switch the enabled state and the disabled state of the operating device 26. According to this embodiment, the control valve 60 is a solenoid valve and is configured to operate in response to a current command from the controller 30. The enabled state of the operating device 26 is a state where the operator can move an associated driven body by operating the operating device 26. The disabled state of the operating device 26 is a state where the operator cannot move an associated driven body even when the operator operates the operating device 26.

According to this embodiment, the control valve 60 is a spool solenoid valve that can switch the opening and closing of a pilot line CD1 connecting the pilot pump 15 and the operating device 26. Specifically, the control valve 60 is configured to switch the opening and closing of the pilot line CD1 in response to a command from the controller 30. More specifically, the control valve 60 opens the pilot line CD1 when the control valve 60 in a first valve position and closes the pilot line CD1 when the control valve 60 in a second valve position. FIG. 3 illustrates that the control valve 60 is in the first position and that the pilot line CD1 is open.

The control valve 60 may also be configured to operate together with a gate lock lever that is not depicted. Specifically, the control valve 60 may also be configured to close the pilot line CD1 when the gate lock lever is pushed down and open the pilot line CD1 when the gate lock lever is pulled up.

Figure 4:
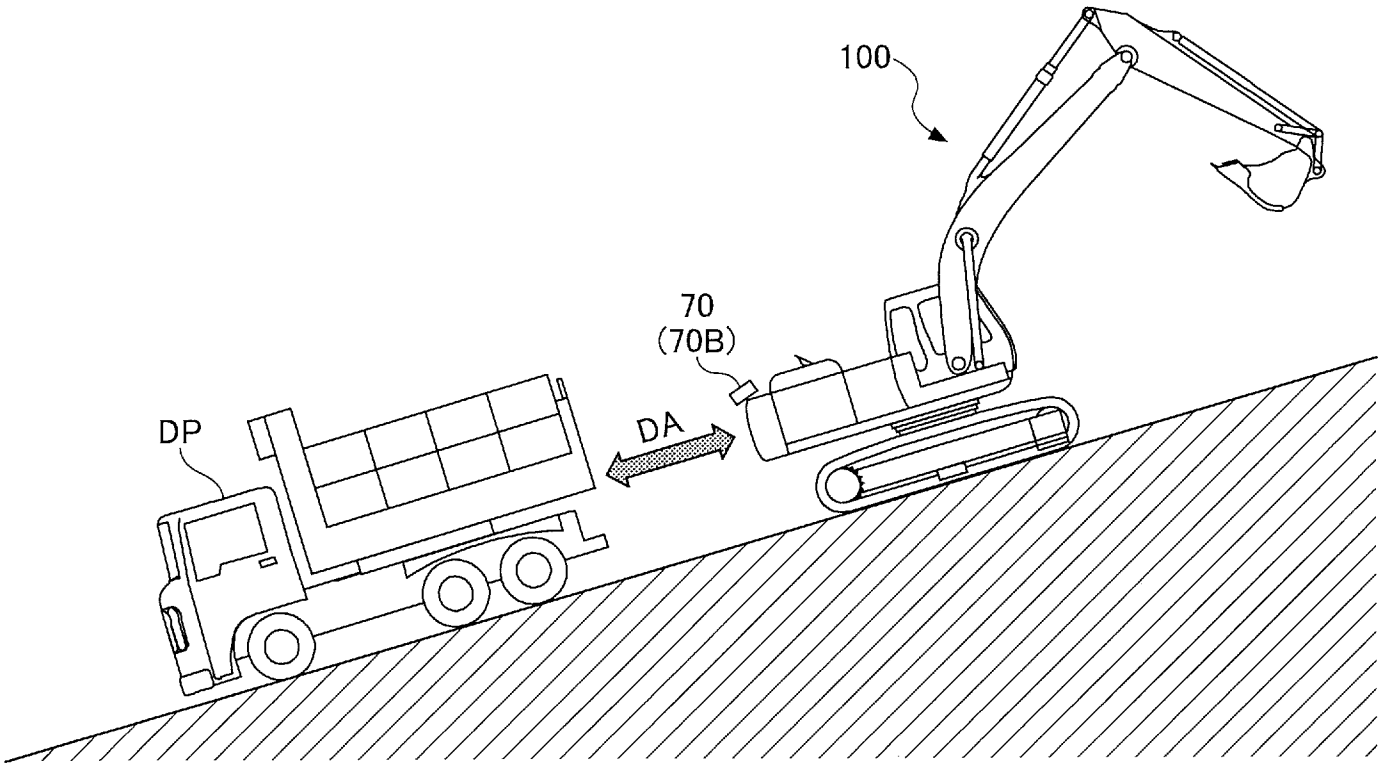
FIG. 4 is a side view of the shovel working on a slope.
Figure 5:
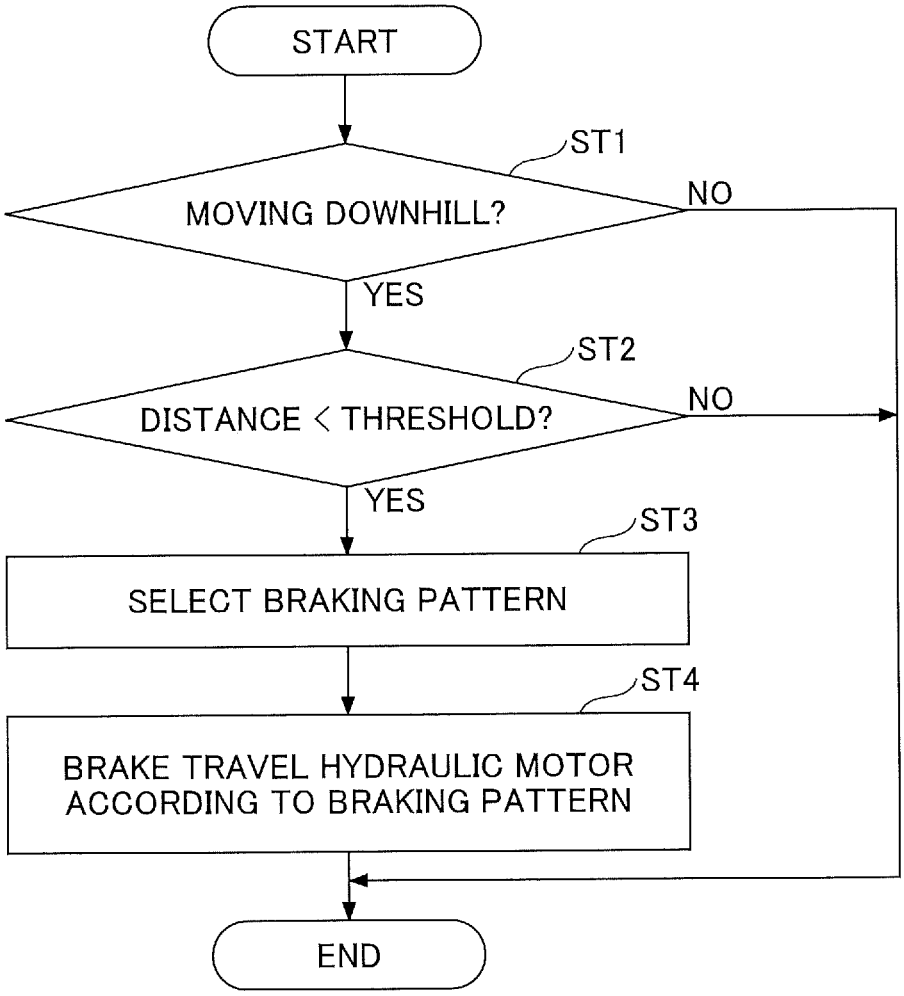
FIG. 5 is a flowchart of an example of an automatic braking process.

Next, a process of the controller 30 automatically braking a drive part of the shovel 100 using the control valve 60 (hereinafter "automatic braking process") is described with reference to FIGS. 4 and 5. FIG. 4 is a side view of the shovel 100 working on a slope. FIG. 5 is a flowchart of an example of the automatic braking process. The controller 30, for example, repeatedly executes this automatic braking process at predetermined control intervals.

According to the example of FIG. 4, the shovel 100 detects a dump truck DP that is stopped on a slope with the object detector 70. To perform the work of loading the bed of the dump truck DP with earth, the shovel 100 is moving back toward the dump truck DP. The controller 30 continuously monitors a distance DA between the shovel 100 (counterweight) and the dump truck DP based on the output of the back sensor 70B. The controller 30 may also be configured to continuously monitor the distance DA based on the output of a distance sensor such as a millimeter wave sensor. Normally, the operator of the shovel 100 tries to stop the backward movement of the shovel 100 by returning the travel lever 26D to a neutral position when the distance DA becomes a desired distance.

The operator of the shovel 100, however, may continue to move the shovel 100 backward without noticing that the distance DA has become a desired distance.

Therefore, the controller 30 outputs an electric current command to the control valve 60 when the distance DA is less than a predetermined first threshold TH1. According to this embodiment, the control valve 60 is configured to be in the first valve position when the current command value is zero and be in the second valve position when the current command value is a predetermined upper limit value Amax. That is, the control valve 60 is configured to disable the operating device 26 when the current command value is the upper limit value Amax. This indicates that a brake force increases as the current command value increases. Specifically, when the distance DA is less than the first threshold TH1, the controller 30 outputs a current command to the control valve 60 to disable the travel lever 26D. Therefore, when the distance DA is less than the first threshold TH1, the control valve 171 and the control valve 172 return to a neutral position to block the flow of hydraulic oil from the main pump 14 to the travel hydraulic motor 2M. As a result, the travel hydraulic motor 2M stops rotating, so that the shovel 100 stops moving backward.

The controller 30, for example, brakes the travel hydraulic motor 2M serving as a drive part according to one of multiple braking patterns which one is according to the distance DA between the counterweight and the dump truck DP detected by the object detector 70.

Specifically, the controller 30 first determines whether a downhill movement is being made (step ST1). According to this embodiment, the controller 30 determines whether a downhill movement is being made based on the respective outputs of the operating pressure sensor 29, the body tilt sensor S4, and the orientation detector 85. The downhill movement includes a backward downhill movement and a forward downhill movement. The controller 30 may determine whether a downhill movement is being made based on an image captured by a camera or the like.

In response to determining that no downhill movement is being made (NO at step ST1), the controller 30 ends the automatic braking process of this time.

In response to determining that a downhill movement is being made (YES at step ST1), the controller 30 determines whether the distance DA between the shovel 100 (for example, a counterweight) and the dump truck DP is less than the first threshold TH1.

In response to determining that the distance DA is more than or equal to the first threshold TH1 (NO at step ST2), the controller 30 ends the automatic braking process of this time.

In response to determining that the distance DA is less than the first threshold TH1 (YES at step ST2), the controller 30 selects a braking pattern (step ST3). Multiple braking patterns are prepared according to the size of a downhill angle (the slope of a downhill). The braking patterns may be determined such that the rate of increase of a braking force per unit time increases as the downhill angle increases, for example. The braking patterns may also be determined such that braking starts earlier as the downhill angle becomes greater, for example. According to this embodiment, the braking patterns are patterns that represent the correspondence between the distance DA and the current command value for the control valve 60. The controller 30 selects a braking pattern corresponding to the inclination angle of the longitudinal axis of the undercarriage 1 relative to a horizontal plane.

Thereafter, the controller 30 brakes the travel hydraulic motor 2M according to the selected braking pattern (step ST4). According to this embodiment, the controller 30 reduces a pilot pressure generated by the travel lever 26D by outputting a current command of the magnitude determined by the selected braking pattern to the control valve 60. Therefore, the control valve 171 corresponding to the left travel hydraulic motor 2ML shifts toward a neutral valve position to restrict and finally block the flow of hydraulic oil from the left main pump 14L to the left travel hydraulic motor 2ML. Likewise, the control valve 172 corresponding to the right travel hydraulic motor 2MR shifts toward a neutral valve position to restrict and finally block the flow of hydraulic oil from the right main pump 14R to the right travel hydraulic motor 2MR. As a result, the rotation of the travel hydraulic motor 2M is reduced and finally stopped, so that the undercarriage 1 stops moving down the hill.

When the downhill movement nevertheless continues so that the distance DA is less than a second threshold TH2 smaller than the first threshold TH1, the controller 30 may stop the rotation of the travel hydraulic motor 2M by actuating a mechanical brake.

Figure 6:
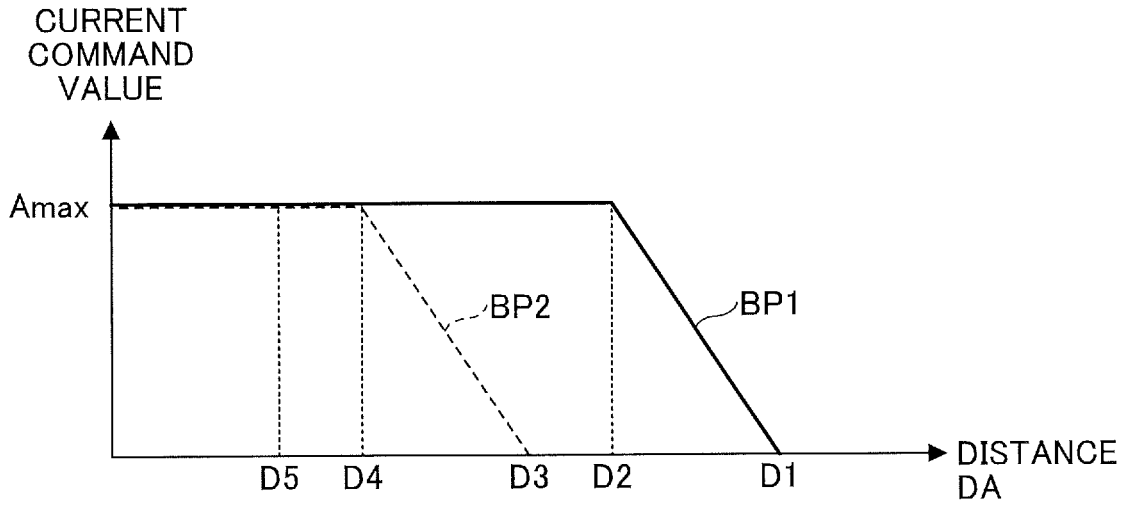
FIG. 6 is a graph illustrating examples of braking patterns.
Figure 7:
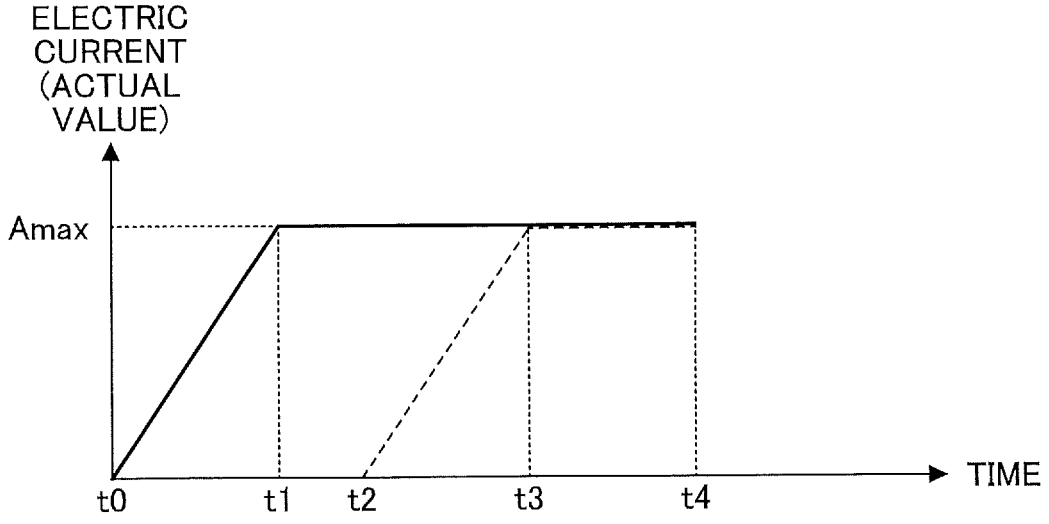
FIG. 7 is a graph illustrating temporal transitions of electric current actually supplied to a control valve.

Next, examples of braking patterns selected during travel are described with reference to FIGS. 6 and 7. FIG. 6 illustrates examples of braking patterns expressed as the correspondence between the distance DA and the current command value. The solid line of FIG. 6 indicates a braking pattern BP1 that is selected during the downhill movement of the shovel 100. The dashed line of FIG. 6 indicates a braking pattern BP2 that is selected during the travel of the shovel 100 on level ground. According to this example, to facilitate comparison, the shovel 100 moving downhill and the shovel 100 traveling on level ground are concurrently traveling at the same constant speed in parallel. The two shovels 100 are controlled by the automatic braking process according to their respective selected braking patterns in such a manner as to have substantially the same distance DA when the shovels 100 stop traveling. FIG. 7 illustrates the temporal transitions of electric current actually supplied to the control valve 60 when the travel hydraulic motor 2M is braked using the braking patterns of FIG. 6. The solid line of FIG. 7 indicates the temporal transition of electric current (actual value) when the braking pattern BP1 indicated by the solid line of FIG. 6 is selected. The dashed line of FIG. 7 indicates the temporal transition of electric current (actual value) when the braking pattern BP2 indicated by the dashed line of FIG. 6 is selected.

As indicated by the solid line of FIG. 6, during the downhill movement of the shovel 100, the controller 30 increases the current command value for the control valve 60 when the distance DA falls below distance D1 serving as the first threshold TH1 set for downhill movement. Distance D1 is, for example, 8 meters. According to this example, the current command value is so determined as to increase at a predetermined rate of increase per unit time or at a predetermined rate of increase per unit distance such that the distance DA becomes the upper limit value Amax at distance D2. When the braking pattern BP1 is selected, the actual electric current supplied to the control valve 60 starts to increase at time t0 at which the distance DA falls below distance D1, and reaches the upper limit value Amax at time t1, as indicated by the solid line of FIG. 7. Through the automatic braking process using this braking pattern BP1, the controller 30 can stop the travel of the shovel 100 moving downhill at distance D5 from an object (for example, the dump truck DP) at time t4.

Furthermore, as indicated by the dashed line of FIG. 6, during the travel of the shovel 100 on level ground, the controller 30 increases the current command value for the control valve 60 when the distance DA falls below distance D3 (<D1) serving as the first threshold TH1 set for travel on level ground. Distance D3 is, for example, 5 meters. According to this example, the current command value is so determined as to increase at a predetermined rate of increase per unit time or at a predetermined rate of increase per unit distance such that the distance DA becomes the upper limit value Amax at distance D4. When the braking pattern BP2 is selected, the actual electric current supplied to the control valve 60 starts to increase at time t2 at which the distance DA falls below distance D3, and reaches the upper limit value Amax at time t3, as indicated by the dashed line of FIG. 7. That is, the controller 30 starts to brake the travel hydraulic motor 2M later than when the braking pattern BP1 is selected. Through the automatic braking process using this braking pattern BP2, the controller 30 can stop the travel of the shovel 100 on level ground at distance D5 from an object (for example, the dump truck DP) at time t4, the same as in the case of the shovel 100 moving downhill.

According to the above-described example, the rate of increase of the current command value in the braking pattern BP1 is equal to the rate of increase of the current command value in the braking pattern BP2. The rate of increase of the current command value in the braking pattern BP1, however, may be set to differ from the rate of increase of the current command value in the braking pattern BP2. In this case, the timing of a braking start in the braking pattern BP1 may be equal to the timing of a braking start in the braking pattern BP2.

Figure 8:
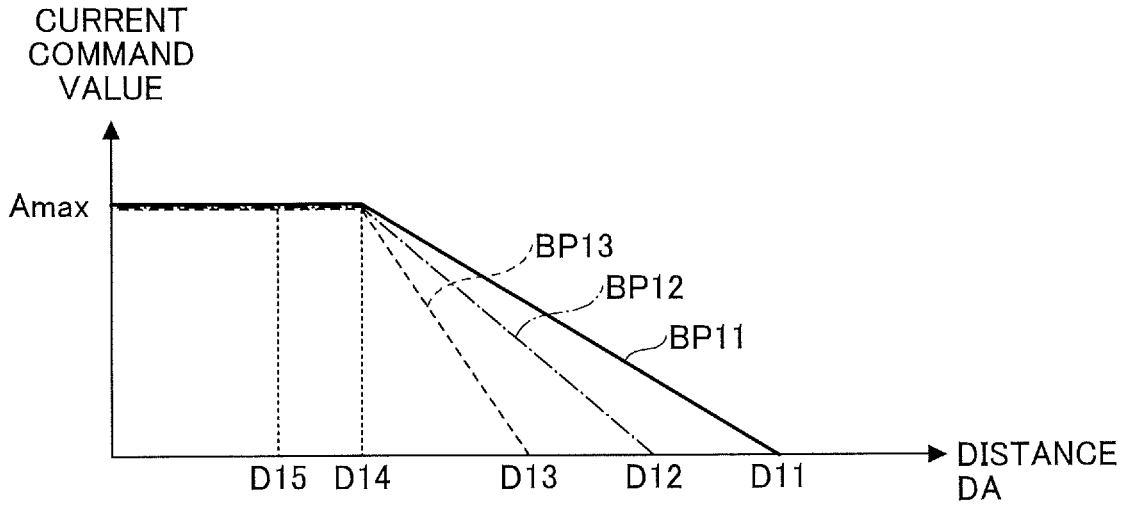
FIG. 8 is a graph illustrating other examples of braking patterns.
Figure 9:
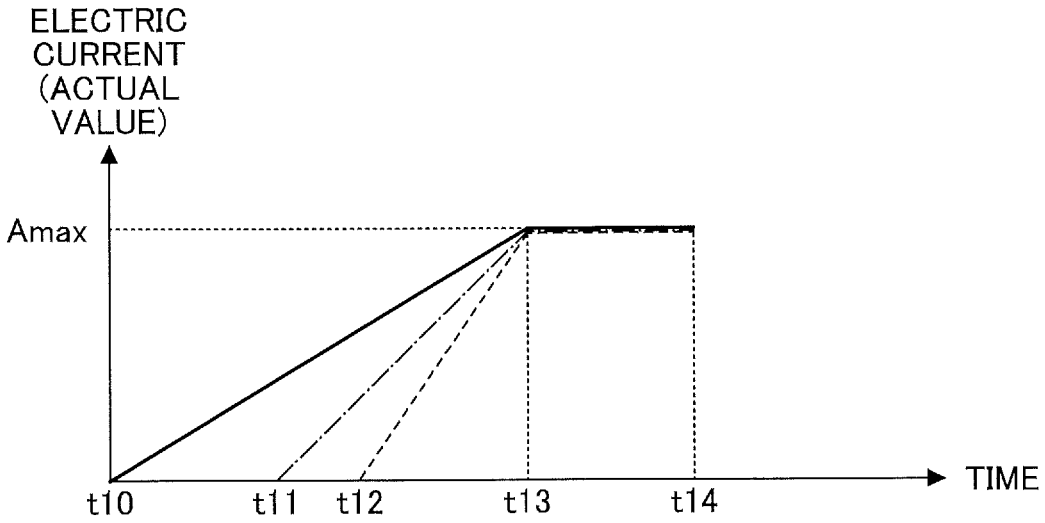
FIG. 9 is a graph illustrating temporal transitions of electric current actually supplied to the control valve.

Next, other examples of braking patterns selected during travel are described with reference to FIGS. 8 and 9. FIG. 8 illustrates other examples of braking patterns expressed as the correspondence between the distance DA and the current command value, and corresponds to FIG. 6. The solid line of FIG. 8 indicates a braking pattern BP11 that is selected during the downhill movement of the shovel 100 on a steep hill. The one-dot chain line of FIG. 8 indicates a braking pattern BP12 that is selected during the downhill movement of the shovel 100 on a gentle hill. The dashed line of FIG. 8 indicates a braking pattern BP13 that is selected during the travel of the shovel 100 on level ground. According to this example, to facilitate comparison, the shovel 100 moving downhill and the shovel 100 traveling on level ground are concurrently traveling at the same constant speed in parallel. The three shovels 100 are controlled by the automatic braking process according to their respective selected braking patterns in such a manner as to have substantially the same distance DA when the shovels 100 stop traveling. FIG. 9 illustrates the temporal transitions of electric current actually supplied to the control valve 60 when the travel hydraulic motor 2M is braked using the braking patterns of FIG. 8. The solid line of FIG. 9 indicates the temporal transition of electric current (actual value) when the braking pattern BP11 indicated by the solid line of FIG. 8 is selected. The one-dot chain line of FIG. 9 indicates the temporal transition of electric current (actual value) when the braking pattern BP12 indicated by the one-dot chain line of FIG. 8 is selected. The dashed line of FIG. 9 indicates the temporal transition of electric current (actual value) when the braking pattern BP13 indicated by the dashed line of FIG. 8 is selected.

As indicated by the solid line of FIG. 8, during the downhill movement of the shovel 100 on a steep hill, the controller 30 increases the current command value for the control valve 60 when the distance DA falls below distance D11 serving as the first threshold TH1 set for downhill movement on a steep hill. Distance D11 is, for example, 8 meters. According to this example, the current command value is so determined as to increase at a predetermined rate of increase per unit time or at a predetermined rate of increase per unit distance such that the distance DA becomes the upper limit value Amax at distance D14. When the braking pattern BP11 is selected, the actual electric current supplied to the control valve 60 starts to increase at time t10 at which the distance DA falls below distance D11, and reaches the upper limit value Amax at time t13, as indicated by the solid line of FIG. 9. Through the automatic braking process using this braking pattern BP11, the controller 30 can stop the travel of the shovel 100 moving downhill at distance D15 from an object (for example, the dump truck DP) at time t14.

Furthermore, as indicated by the one-dot chain line of FIG. 8, during the downhill movement of the shovel 100 on a gentle hill, the controller 30 increases the current command value for the control valve 60 when the distance DA falls below distance D12 (<D11) serving as the first threshold TH1 set for downhill movement on a gentle hill. Distance D12 is, for example, 6.5 meters. According to this example, the current command value is so determined as to increase at a predetermined rate of increase per unit time or at a predetermined rate of increase per unit distance such that the distance DA becomes the upper limit value Amax at distance D14. When the braking pattern BP12 is selected, the actual electric current supplied to the control valve 60 starts to increase at time t11 at which the distance DA falls below distance D12, and reaches the upper limit value Amax at time t13, as indicated by the one-dot chain line of FIG. 9. That is, the controller 30 starts to brake the travel hydraulic motor 2M later than when the braking pattern BP11 is selected. Through the automatic braking process using this braking pattern BP12, the controller 30 can stop the travel of the shovel 100 moving downhill at distance D15 from an object (for example, the dump truck DP) at time t14.

Furthermore, as indicated by the dashed line of FIG. 8, during the travel of the shovel 100 on level ground, the controller 30 increases the current command value for the control valve 60 when the distance DA falls below distance D13 (<D12) serving as the first threshold TH1 set for travel on level ground. Distance D13 is, for example, 5 meters. According to this example, the current command value is so determined as to increase at a predetermined rate of increase per unit time or at a predetermined rate of increase per unit distance such that the distance DA becomes the upper limit value Amax at distance D14. When the braking pattern BP13 is selected, the actual electric current supplied to the control valve 60 starts to increase at time t12 at which the distance DA falls below distance D13, and reaches the upper limit value Amax at time t13, as indicated by the dashed line of FIG. 9. That is, the controller 30 starts to brake the travel hydraulic motor 2M later than when the braking pattern BP12 is selected. Through the automatic braking process using this braking pattern BP13, the controller 30 can stop the travel of the shovel 100 on level ground at distance D15 from an object (for example, the dump truck DP) at time t14, the same as in the case of the shovel 100 moving downward on a steep hill and the case of the shovel 100 moving downward on a gentle hill.

According to the above-described example, the timing of the current command value reaching the upper limit value Amax in the braking pattern BP11 is equal to the timing of the current command value reaching the upper limit value Amax in the braking pattern BP12 and the timing of the current command value reaching the upper limit value Amax in the braking pattern BP13. The timing of the current command value reaching the upper limit value Amax, however, may differ from braking pattern to braking pattern.

Figure 10A:
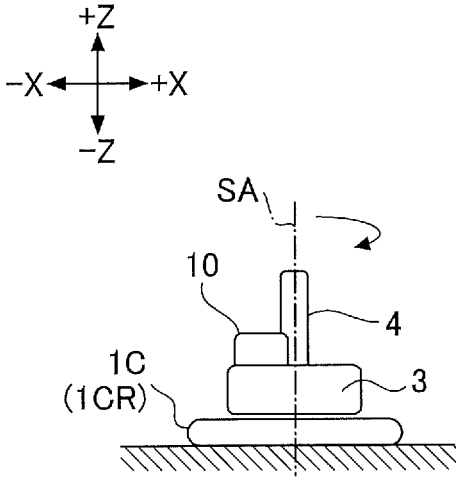
FIG. 10A is a side view of the shovel.
Figure 10B:
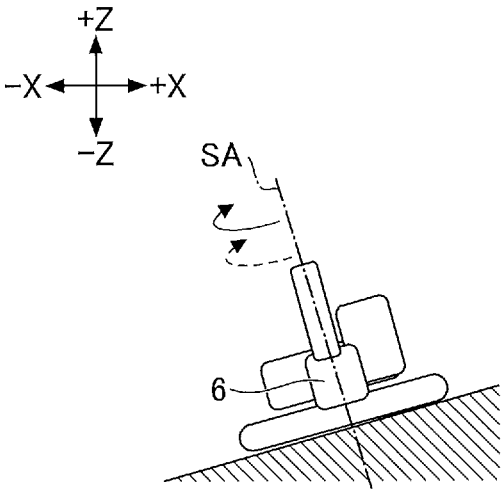
FIG. 10B is a side view of the shovel.
Figure 10C:
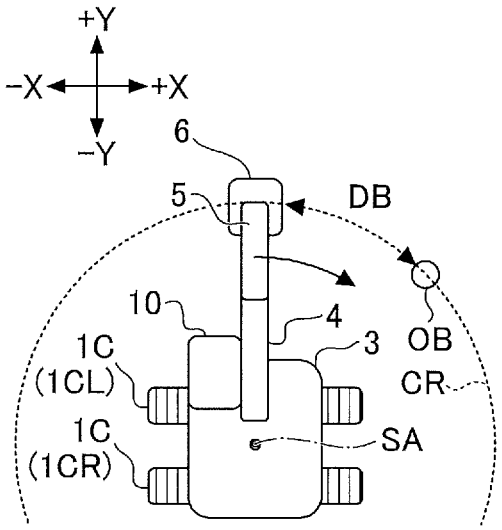
FIG. 10C is a plan view of the shovel.
Figure 10D:
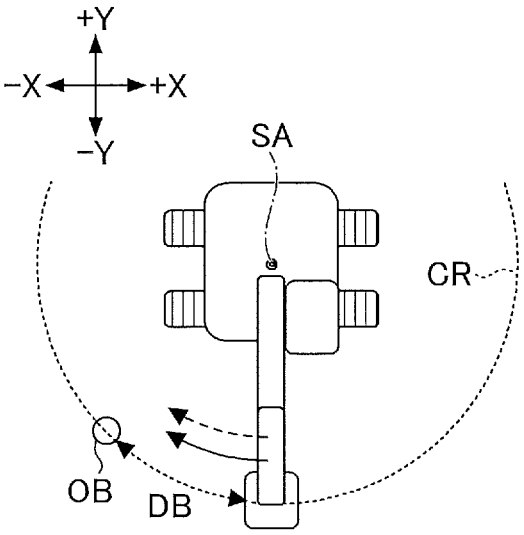
FIG. 10D is a plan view of the shovel.

Next, a swing motion is described with reference to FIGS. 10A through 10D. FIGS. 10A and 10B are side views of the shovel 100. FIGS. 10C and 10D are plan views of the shovel 100. Furthermore, FIGS. 10A and 10C illustrate a swing motion performed on level ground, and FIGS. 10B and 10D illustrate a swing motion performed on a slope. Furthermore, in each of FIGS. 10A through 10D, a solid arrow indicates a direction in which a swing force created by the swing hydraulic motor 2A acts, and a dotted arrow indicates a direction in which a swing force due to the self-weight of the upper swing structure 3 acts.

According to the example of FIGS. 10B and 10D, the arm 5 is wide open. Therefore, the center of gravity of the upper swing structure 3 including the excavation attachment is on the front side of a swing axis SA. That is, the center of gravity of the upper swing structure 3 including the excavation attachment is at a position more distant from the back end of the upper swing structure 3 than is the swing axis SA. Therefore, when the shovel 100 is positioned on a slope, the upper swing structure 3 is going to swing, because of its own weight, such that the bucket 6 moves toward a lower position. However, when the shovel 100 is positioned on a slope and the center of gravity of the upper swing structure 3 including the excavation attachment is on the back side of the swing axis SA, that is, the center of gravity of the upper swing structure 3 including the excavation attachment is closer to the back end of the upper swing structure 3 than is the swing axis SA, the upper swing structure 3 is going to swing, because of its own weight, such that the counterweight moves toward a lower position.

Figure 11:
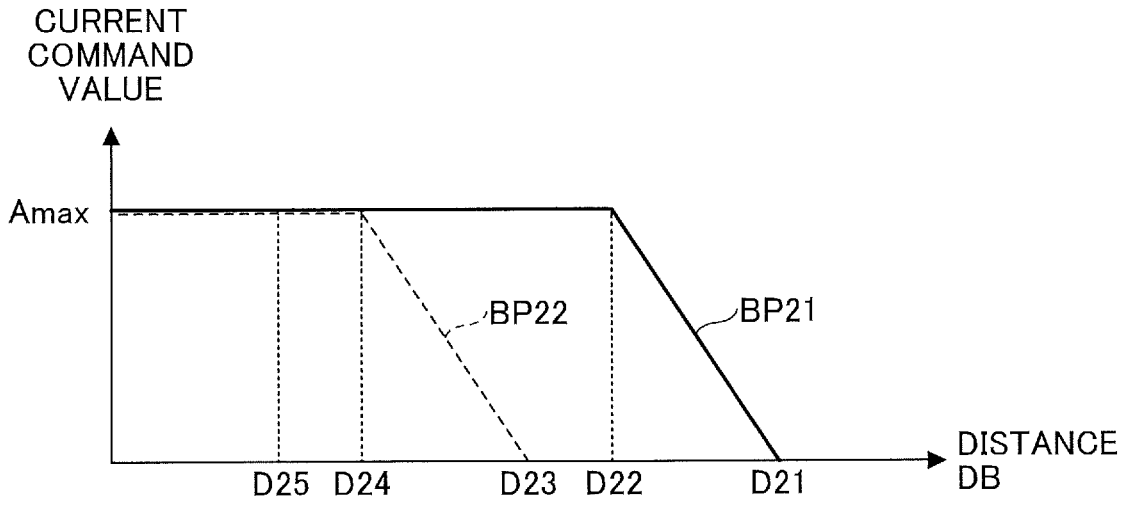
FIG. 11 is a graph illustrating yet other examples of braking patterns.
Figure 12:
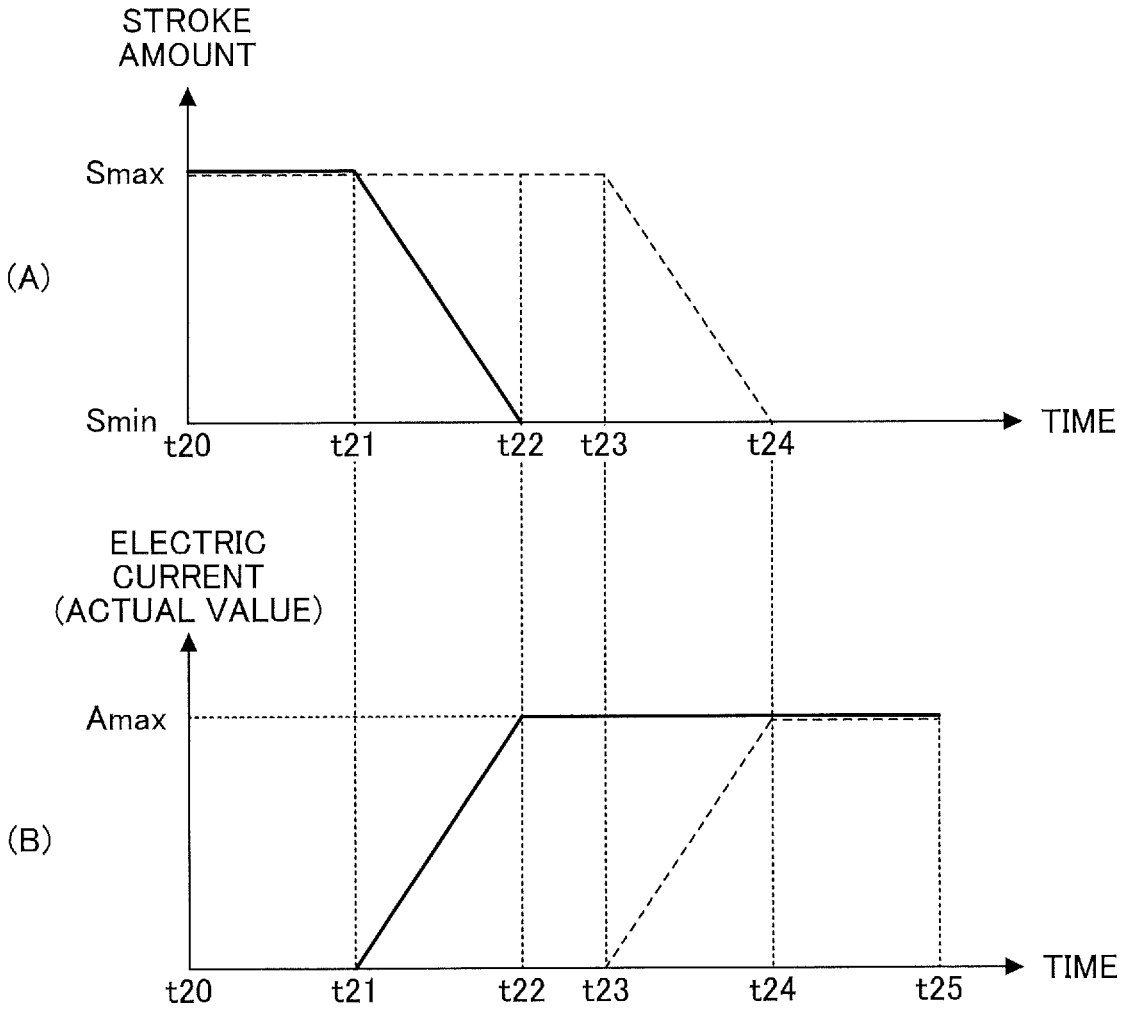
FIG. 12 illustrates temporal transitions of electric current supplied to the control valve and the amount of stroke.

Next, examples of braking patterns selected during a swing motion are described with reference to FIGS. 11, 12A and 12B. According to this example, the controller 30 brakes the swing hydraulic motor 2A serving as a drive part according to one of multiple braking patterns that are according to a distance DB between the bucket 6 and an object OB (see FIG. 10C), detected by the object detector 70 during a swing motion on level ground. The distance DB is, for example, the length of an arc between the bucket 6 and the object OB in a swing circle CR drawn by the bucket 6 during a swing motion as illustrated in FIG. 10C. FIG. 11 illustrates examples of braking patterns expressed as the correspondence between the distance DB and the current command value, and corresponds to FIG. 6. The solid line of FIG. 11 indicates a braking pattern BP21 that is selected during the swing motion of the shovel 100 with a relatively large swing radius. The dashed line of FIG. 11 indicates a braking pattern BP22 that is selected during the swing motion of the shovel 100 with a relatively small swing radius. The swing radius is calculated based on, for example, the respective outputs of the boom angle sensor S1, the arm angle sensor S2, and the bucket angle sensor S3. According to this example, to facilitate comparison, the shovel 100 performing a swing motion with a relatively large swing radius and the shovel 100 performing a swing motion with a relatively small swing radius are concurrently swinging at the same constant swing speed in parallel. The two shovels 100 are controlled by the automatic braking process according to their respective selected braking patterns in such a manner as to have substantially the same distance DB when the shovels 100 stop swinging. FIG. 12 includes (A) and (B), where (A) illustrates the temporal transitions of the stroke amount of the control valve 60 when the swing hydraulic motor 2A is braked using the braking patterns of FIG. 11 and (B) illustrates the temporal transitions of electric current actually supplied to the control valve 60 when the swing hydraulic motor 2A is braked using the braking patterns of FIG. 11. Specifically, in FIG. 12, the solid line indicates a temporal transition when the braking pattern BP21 indicated by the solid line of FIG. 11 is selected, and the dashed line indicates a temporal transition when the braking pattern BP22 indicated by the dashed line of FIG. 11 is selected.

As indicated by the solid line of FIG. 11, when the shovel 100 positioned on level ground is performing a swing motion with a relatively large swing radius, the controller 30 increases the current command value for the control valve 60 when the distance DB falls below distance D21 serving as a third threshold TH3 set for swinging with a relatively large swing radius. Distance D21 is, for example, 5 meters. According to this example, the current command value is so determined as to increase at a predetermined rate of increase per unit time or at a predetermined rate of increase per unit distance such that the distance DB becomes the upper limit value Amax at distance D22. When the braking pattern BP21 is selected, the actual electric current supplied to the control valve 60 starts to increase at time t21 at which the distance DB falls below distance D21, and reaches the upper limit value Amax at time t22, as indicated by the solid line of (B) of FIG. 12. The stroke amount of the control valve 60 starts to decrease at time t21, and reaches a lower limit value Smin at time t22, as indicated by the solid line of (A) of FIG. 12. That is, the pilot line CD1 in which the control valve 60 is installed is closed. Through the automatic braking process using this braking pattern BP21, the controller 30 can stop the swing motion of the shovel 100 at distance D25 from the object OB at time t25.

Furthermore, as indicated by the dashed line of FIG. 11, when the shovel 100 positioned on level ground is performing a swing motion with a relatively small swing radius, the controller 30 increases the current command value for the control valve 60 when the distance DB falls below distance D23 (<D21) serving as the third threshold TH3 set for swinging with a relatively small swing radius. Distance D23 is, for example, 3 meters. According to this example, the current command value is so determined as to increase at a predetermined rate of increase per unit time or at a predetermined rate of increase per unit distance such that the distance DB becomes the upper limit value Amax at distance D24. When the braking pattern BP22 is selected, the actual electric current supplied to the control valve 60 starts to increase at time t23 at which the distance DB falls below distance D23, and reaches the upper limit value Amax at time t24, as indicated by the dashed line of (B) of FIG. 12. The stroke amount of the control valve 60 starts to decrease at time t23, and reaches the lower limit value Smin at time t24, as indicated by the dashed line of (A) of FIG. 12. That is, the pilot line CD1 in which the control valve 60 is installed is closed. Through the automatic braking process using this braking pattern BP22, the controller 30 can stop the swing motion of the shovel 100 at distance D25 from the object OB at time t25.

This configuration enables the controller 30 to automatically stop the swing hydraulic motor 2A appropriately regardless of the size of a swing radius, namely, regardless of the pose of the excavation attachment. For example, the controller 30 can stop the swing motion of the shovel 100 where the distance DB becomes distance D25.

According to the above-described example, the rate of increase of the current command value in the braking pattern BP21 is equal to the rate of increase of the current command value in the braking pattern BP22. The rate of increase of the current command value in the braking pattern BP21, however, may be set to differ from the rate of increase of the current command value in the braking pattern BP22. In this case, the timing of a braking start in the braking pattern BP21 may be equal to the timing of a braking start in the braking pattern BP22.

Figure 13:
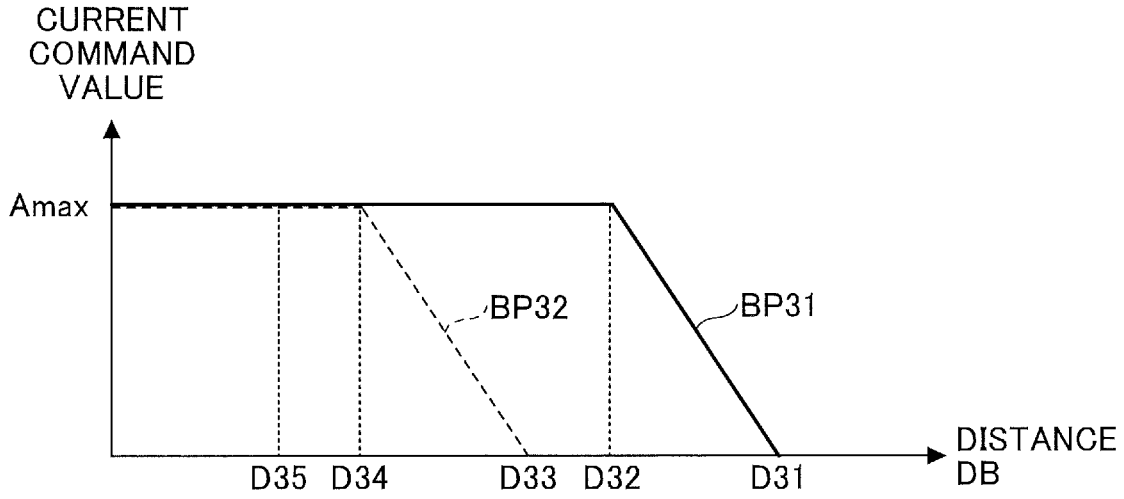
FIG. 13 is a graph illustrating still other examples of braking patterns.
Figure 14:
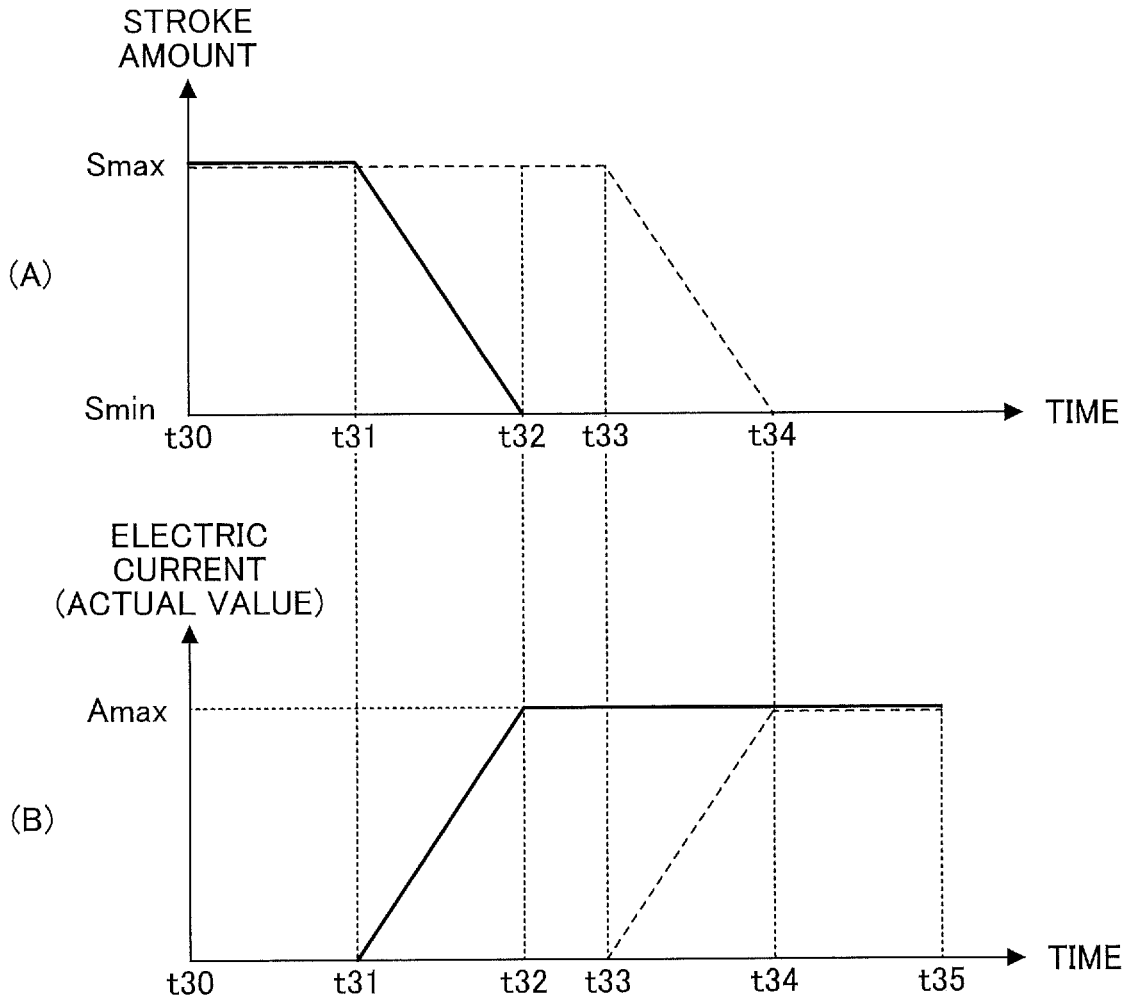
FIG. 14 illustrates temporal transitions of electric current supplied to the control valve and the amount of stroke.

Next, other examples of braking patterns selected during a swing motion are described with reference to FIGS. 13, 14A and 14B. According to this example, the controller 30 brakes the swing hydraulic motor 2A serving as a drive part according to one of multiple braking patterns which are according to the distance DB between the bucket 6 and the object OB (see FIGS. 10C and 10D), detected by the object detector 70 during a swing motion. The distance DB is, for example, the length of an arc between the bucket 6 and the object OB in the swing circle CR drawn by the bucket 6 during a swing motion as illustrated in each of FIGS. 10C and 10D. FIG. 13 illustrates examples of braking patterns expressed as the correspondence between the distance DB and the current command value, and corresponds to FIG. 6. The solid line of FIG. 13 indicates a braking pattern BP31 that is selected during the downward swing motion of the shovel 100. The dashed line of FIG. 13 indicates a braking pattern BP32 that is selected during the swing motion of the shovel 100 on level ground. According to this example, to facilitate comparison, the shovel 100 performing a downward swing motion and the shovel 100 performing a swing motion on level ground are concurrently swinging at the same constant swing speed in parallel. The two shovels 100 are controlled by the automatic braking process according to their respective selected braking patterns in such a manner as to have substantially the same distance DB when the shovels 100 stop swinging. FIG. 14 includes (A) and (B), where (A) illustrates the temporal transitions of the stroke amount of the control valve 60 when the swing hydraulic motor 2A is braked using the braking patterns of FIG. 13 and (B) illustrates the temporal transitions of electric current actually supplied to the control valve 60 when the swing hydraulic motor 2A is braked using the braking patterns of FIG. 13. In FIG. 14, the solid line indicates a temporal transition when the braking pattern BP31 indicated by the solid line of FIG. 13 is selected, and the dashed line indicates a temporal transition when the braking pattern BP32 indicated by the dashed line of FIG. 13 is selected.

As indicated by the solid line of FIG. 13, when the shovel 100 is performing a downward swing motion, the controller 30 increases the current command value for the control valve 60 when the distance DB falls below distance D31 serving as the third threshold TH3 set for a downward swing motion. Distance D31 is, for example, 5 meters. According to this example, the current command value is so determined as to increase at a predetermined rate of increase per unit time or at a predetermined rate of increase per unit distance such that the distance DB becomes the upper limit value Amax at distance D32. When the braking pattern BP31 is selected, the actual electric current supplied to the control valve 60 starts to increase at time t31 at which the distance DB falls below distance D31, and reaches the upper limit value Amax at time t32, as indicated by the solid line of (B) of FIG. 14. The stroke amount of the control valve 60 starts to decrease at time t31, and reaches the lower limit value Smin at time t32, as indicated by the solid line of (A) of FIG. 14. That is, the pilot line CD1 in which the control valve 60 is installed is closed. Through the automatic braking process using this braking pattern BP31, the controller 30 can stop the downward swing motion of the shovel 100 at distance D35 from the object OB at time t35.

Furthermore, as indicated by the dashed line of FIG. 13, when the shovel 100 positioned on level ground is performing a swing motion, the controller 30 increases the current command value for the control valve 60 when the distance DB falls below distance D33 (<D31) serving as the third threshold TH3 set for a swing motion on level ground. Distance D33 is, for example, 3 meters. According to this example, the current command value is so determined as to increase at a predetermined rate of increase per unit time or at a predetermined rate of increase per unit distance such that the distance DB becomes the upper limit value Amax at distance D34. When the braking pattern BP32 is selected, the actual electric current supplied to the control valve 60 starts to increase at time t33 at which the distance DB falls below distance D33, and reaches the upper limit value Amax at time t34, as indicated by the dashed line of (B) of FIG. 14. The stroke amount of the control valve 60 starts to decrease at time t33, and reaches the lower limit value Smin at time t34, as indicated by the dashed line of (A) of FIG. 14. That is, the pilot line CD1 in which the control valve 60 is installed is closed. Through the automatic braking process using this braking pattern BP32, the controller 30 can stop the swing motion of the shovel 100 at distance D35 from the object OB at time t35.

According to the above-described example, the rate of increase of the current command value in the braking pattern BP31 is equal to the rate of increase of the current command value in the braking pattern BP32. The rate of increase of the current command value in the braking pattern BP31, however, may be set to differ from the rate of increase of the current command value in the braking pattern BP32. In this case, the timing of a braking start in the braking pattern BP31 may be equal to the timing of a braking start in the braking pattern BP32.

Figure 15:
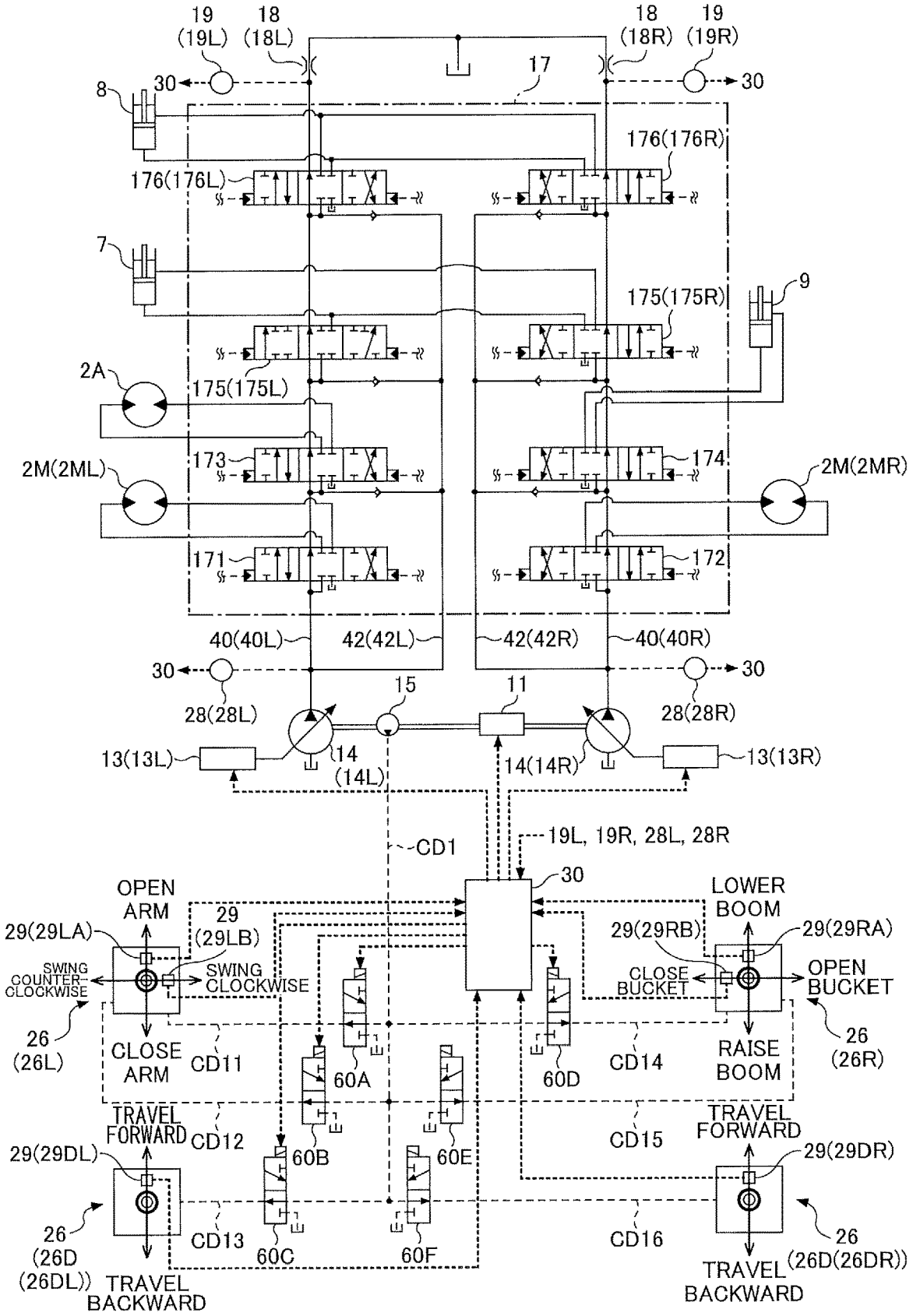
FIG. 15 is a schematic diagram illustrating another example configuration of the hydraulic system installed in the shovel.

Next, another example configuration of the hydraulic system installed in the shovel 100 is described with reference to FIG. 15. FIG. 15 is a schematic diagram illustrating another example configuration of the hydraulic system installed in the shovel 100. The hydraulic system of FIG. 15 is different in being able to smoothly decelerate or stop an actuator to be braked by moving a spool valve associated with the actuator according to a predetermined braking pattern from, but otherwise equal to, the hydraulic system of FIG. 3. Therefore, a description of a common portion is omitted, and differences are described in detail.

The hydraulic system of FIG. 15 includes control valves 60A through 60F. According to this embodiment, the control valve 60A is a solenoid valve that can switch the opening and closing of a pilot line CD11 connecting the pilot pump 15 and a portion of the left operating lever 26L related to an arm operation. Specifically, the control valve 60A is configured to switch the opening and closing of the pilot line CD11 in response to a command from the controller 30.

The control valve 60B is a solenoid valve that can switch the opening and closing of a pilot line CD12 connecting the pilot pump 15 and a portion of the left operating lever 26L related to a swing operation. Specifically, the control valve 60B is configured to switch the opening and closing of the pilot line CD12 in response to a command from the controller 30.

The control valve 60C is a solenoid valve that can switch the opening and closing of a pilot line CD13 connecting the pilot pump 15 and the left travel lever 26DL. Specifically, the control valve 60C is configured to switch the opening and closing of the pilot line CD13 in response to a command from the controller 30.

The control valve 60D is a solenoid valve that can switch the opening and closing of a pilot line CD14 connecting the pilot pump 15 and a portion of the right operating lever 26R related to a boom operation. Specifically, the control valve 60D is configured to switch the opening and closing of the pilot line CD14 in response to a command from the controller 30.

The control valve 60E is a solenoid valve that can switch the opening and closing of a pilot line CD15 connecting the pilot pump 15 and a portion of the right operating lever 26R related to a bucket operation. Specifically, the control valve 60E is configured to switch the opening and closing of the pilot line CD15 in response to a command from the controller 30.

The control valve 60F is a solenoid valve that can switch the opening and closing of a pilot line CD16 connecting the pilot pump 15 and the right travel lever 26DR. Specifically, the control valve 60F is configured to switch the opening and closing of the pilot line CD16 in response to a command from the controller 30.

The control valves 60A through 60F may be configured to operate together with the gate lock lever. Specifically, the control valves 60A through 60F may be configured to close the pilot lines CD11 through CD16 when the gate lock lever is pushed down and open the pilot lines CD11 through CD16 when the gate lock lever is pulled up.

According to this configuration, by moving spool valves associated with actuators corresponding to the portions of the left operating lever 26L related to an arm operation and a swing operation, the portions of the right operating lever 26R related to a boom operation and a bucket operation, the left travel lever 26DL, and the right travel lever 26DR according to predetermined braking patterns, the controller 30 can smoothly decelerate or stop the actuators.

Therefore, the controller 30 can appropriately operate the shovel 100 even when a complex operation is performed. For example, while allowing the movement of a driven body according to one operation in a complex operation, the controller 30 may brake the movement of another driven body according to another operation in the complex operation. The controller 30 may also be configured to, when braking the movement of a driven body according to one operation in a complex operation, brake the movement of another driven body according to another operation in the complex operation.

Figure 16A:
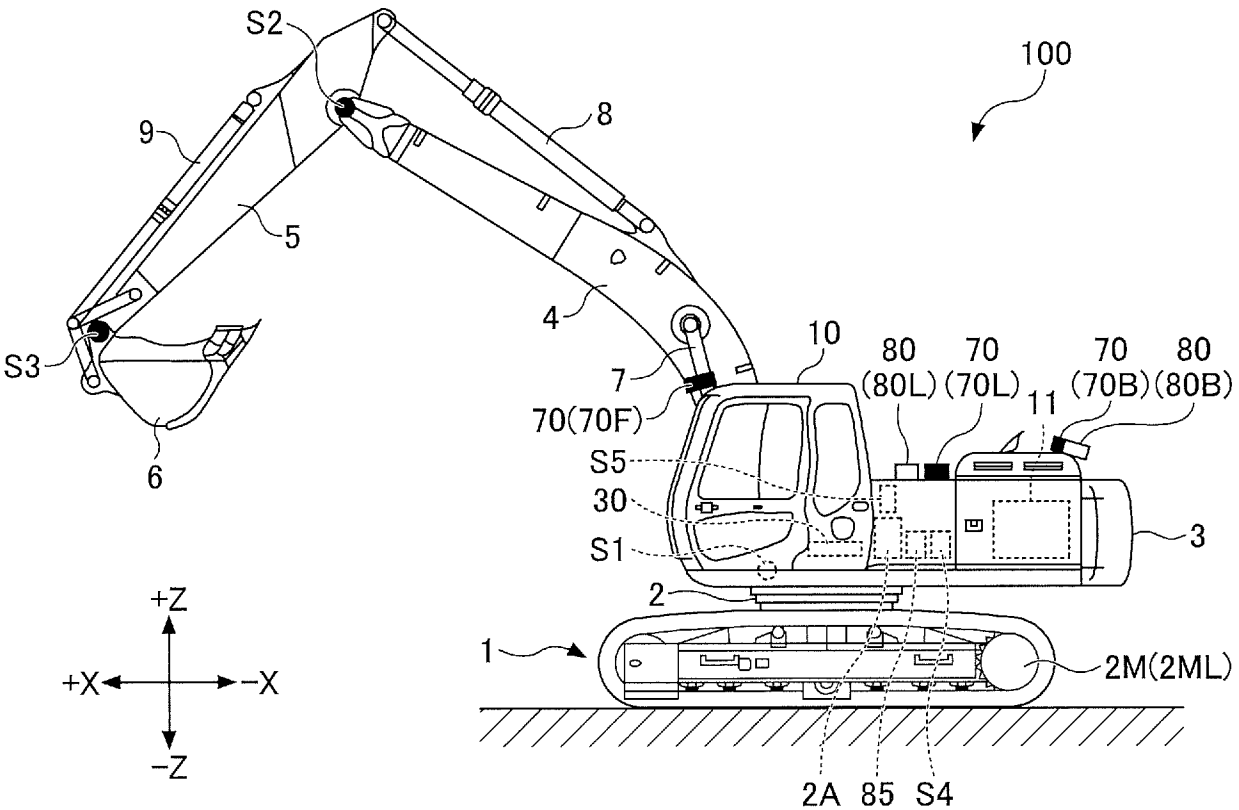
FIG. 16A is a diagram illustrating another example configuration of the shovel according to the embodiment of the present invention.
Figure 16B:
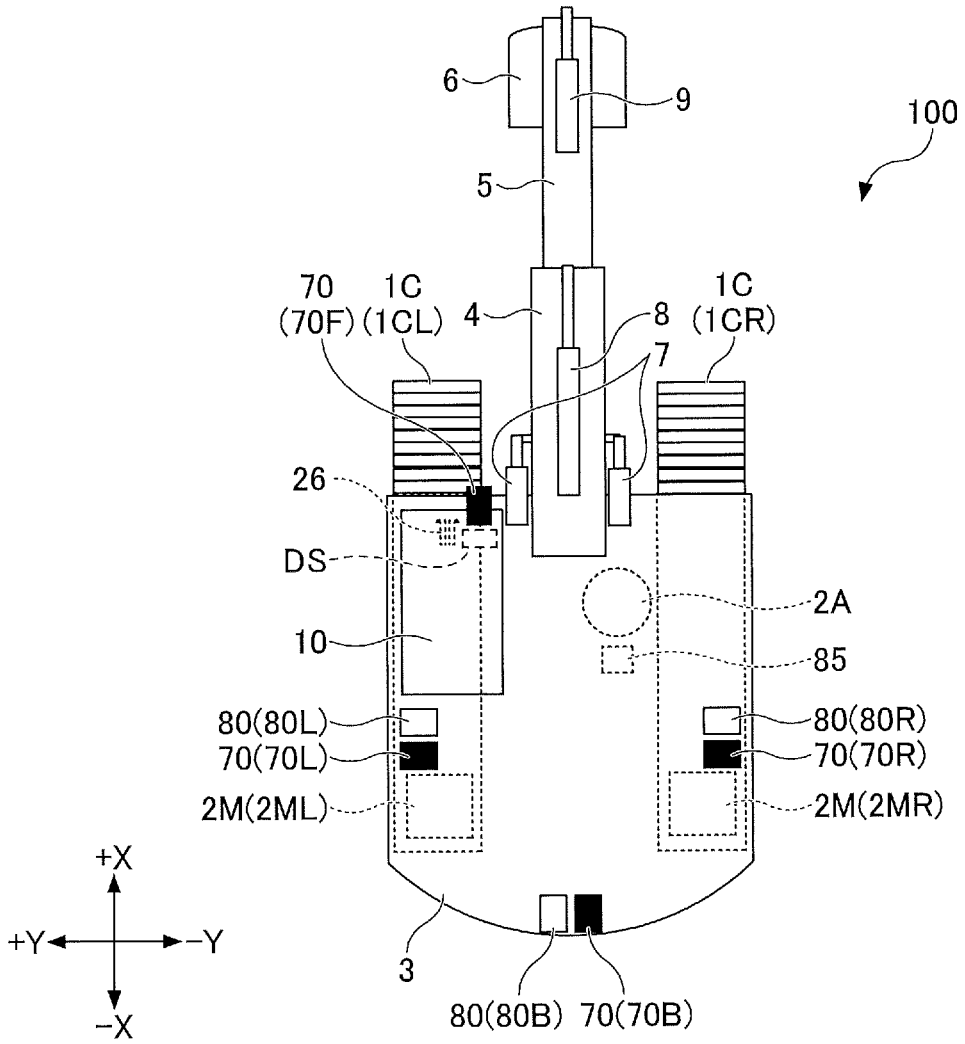
FIG. 16B is a diagram illustrating the other example configuration of the shovel according to the embodiment of the present invention.

Next, another example configuration of the shovel 100 is described with reference to FIGS. 16A and 16B. FIGS. 16A and 16B are diagrams illustrating another example configuration of the shovel 100. FIG. 16A is a side view and FIG. 16B is a plan view.

The shovel 100 of FIGS. 16A and 16B is different in including an image capturing device 80 from, but otherwise equal to, the shovel 100 illustrated in FIGS. 1 and 2. Accordingly, the description of a common portion is omitted, and differences are described in detail.

The image capturing device 80 is another example of the surroundings monitoring device, and is configured to capture an image of an area surrounding the shovel 100. The shovel 100 does not necessarily have to include both the object detector 70 and the image capturing device 80 as surroundings monitoring devices. The surrounding monitoring device may be constituted only of the object detector 70 to the extent that the positional relationship between an object in the surrounding area and the shovel 100 can be determined with the object detector 70, and may be constituted only of the image capturing device 80 to the extent that the positional relationship between an object in the surrounding area and the shovel 100 can be determined with the image capturing device 80. According to the example of FIGS. 16A and 16B, the image capturing device 80 includes a back camera 80B attached to the back end of the upper surface of the upper swing structure 3, a left camera 80L attached to the left end of the upper surface of the upper swing structure 3, and a right camera 80R attached to the right end of the upper surface of the upper swing structure 3. The image capturing device 80 may include a front camera.

The back camera 80B is placed next to the back sensor 70B. The left camera 80L is placed next to the left sensor 70L. The right camera 80R is placed next to the right sensor 70R. When the image capturing device 80 includes a front camera, the front camera may be placed next to the front sensor 70F.

An image captured by the image capturing device 80 is displayed on a display DS installed in the cabin 10. The image capturing device 80 may also be configured to be able to display a viewpoint change image such as an overhead view image on the display DS. The overhead view image is, for example, generated by combining the respective output images of the back camera 80B, the left camera 80L, and the right camera 80R.

This configuration enables the shovel 100 of FIGS. 16A and 16B to display an image of an object detected by the object detector 70 on the display DS. Therefore, when a driven body is restricted or prevented from moving, the operator of the shovel 100 can immediately identify a responsible object by looking at an image displayed on the display DS.

As described above, the shovel 100 according to this embodiment includes the undercarriage 1, the upper swing structure 3 swingably mounted on the undercarriage 1, the object detector 70 provided on the upper swing structure 3, and the controller 30 serving as a control device that can automatically brake a drive part of the shovel 100. The drive part of the shovel 100 includes, for example, at least one of the travel hydraulic motor 2M, the swing hydraulic motor 2A, etc. The travel hydraulic motor 2M may alternatively be a travel electric motor. Furthermore, the swing hydraulic motor 2A may alternatively be a swing electric motor. The controller 30, for example, may automatically brake the drive part according to one of multiple braking patterns which are according to the distance between the shovel 100 and an object, detected by the object detector 70. For example, as illustrated in FIG. 4, the controller 30 may automatically brake the travel hydraulic motor 2M according to one of multiple braking patterns which are according to the distance DA between the shovel 100 and the dump truck DP. Furthermore, for example, as illustrated in FIG. 10C, the controller 30 may automatically brake the swing hydraulic motor 2A according to one of multiple braking patterns which are according to the distance DB between the shovel 100 and the object OB. This configuration enables the controller 30 to automatically stop the shovel 100 more appropriately. The controller 30, for example, can automatically stop the shovel 100 moving downhill the same as in the case of automatically stopping the shovel 100 traveling on level ground. Therefore, the controller is prevented from significantly increasing braking distance compared with the case of automatically stopping the shovel 100 traveling on level ground. As a result, the controller 30 can ensure that the shovel 100 moving downhill stops before contacting an object.

The braking patterns may be determined to start braking with different timings. Specifically, the braking patterns may be determined to start braking with respective different timings like the braking pattern BP1 and the braking pattern BP2 illustrated in FIG. 6. According to the braking pattern BP1, braking starts when the distance DA falls below distance D1 serving as the first threshold TH1. According to the braking pattern BP2, braking starts when the distance DA falls below distance D3 (<D1) serving as the first threshold TH1.

The braking patterns may be determined to differ from each other in the rate of increase of a braking force with respect to the time elapsed since the start of braking. Specifically, the braking patterns may be determined to differ from each other in the rate of increase per unit time or the rate of increase per unit distance of the current command value like the braking patterns BP11 through BP13 illustrated in FIG. 8. According to the example of FIG. 8, the rate of increase per unit time of the current command value associated with the braking pattern BP11 is lower than the rate of increase per unit time of the current command value associated with the braking pattern BP12. Furthermore, the rate of increase per unit time of the current command value associated with the braking pattern BP12 is lower than the rate of increase per unit time of the current command value associated with the braking pattern BP13.

The shovel 100 may include the body tilt sensor S4 that detects the inclination of the shovel 100. In this case, the controller 30 may be configured to switch braking patterns based on the output of the body tilt sensor S4. This configuration enables the controller 30 to switch braking patterns according to the size of the slope of a hill. Therefore, the controller 30 can appropriately stop the travel of the shovel 100 moving downhill, regardless of the size of the slope of a hill. Furthermore, the controller can appropriately stop the swing of the shovel 100 in a downward swing motion, regardless of the size of the slope of a hill.

The braking pattern may be, for example, a braking pattern for a travel actuator. The travel actuator may be, for example, the travel hydraulic motor 2M or a travel electric motor. Furthermore, the braking pattern may be, for example, a braking pattern for a swing actuator. The swing actuator may be, for example, the swing hydraulic motor 2A or a swing electric motor.

The distance detected by the object detector 70 may be, for example, the length of an arc between the end attachment and an object in a swing circle drawn by the end attachment during a swing motion. Specifically, as illustrated in FIG. 100, the distance DB detected by the object detector 70 may be the length of an arc between the bucket 6 and the object OB in the swing circle CR drawn by the bucket 6 during a swing motion. This configuration enables the controller 30 to automatically brake the swing actuator according to one of multiple braking patterns which are according to the distance DB between the object OB on the swing circle CR and the bucket 6.

The controller 30 may also be configured to automatically brake the drive part according to one of multiple braking patterns according to the magnitude of a swing moment. Specifically, for example, as illustrated in FIG. 11, the controller 30 may be configured to switch the braking pattern BP21 and the braking pattern BP22 according to the swing radius of the shovel 100. This is because the swing moment changes according to a change in the swing radius, and specifically because the swing moment increases as the swing radius increases. This configuration enables the controller 30 to switch braking patterns according to the size of a swing radius. Therefore, the controller 30 can appropriately stop the swing of the shovel 100, regardless of the size of a swing radius.

Figure 17A:
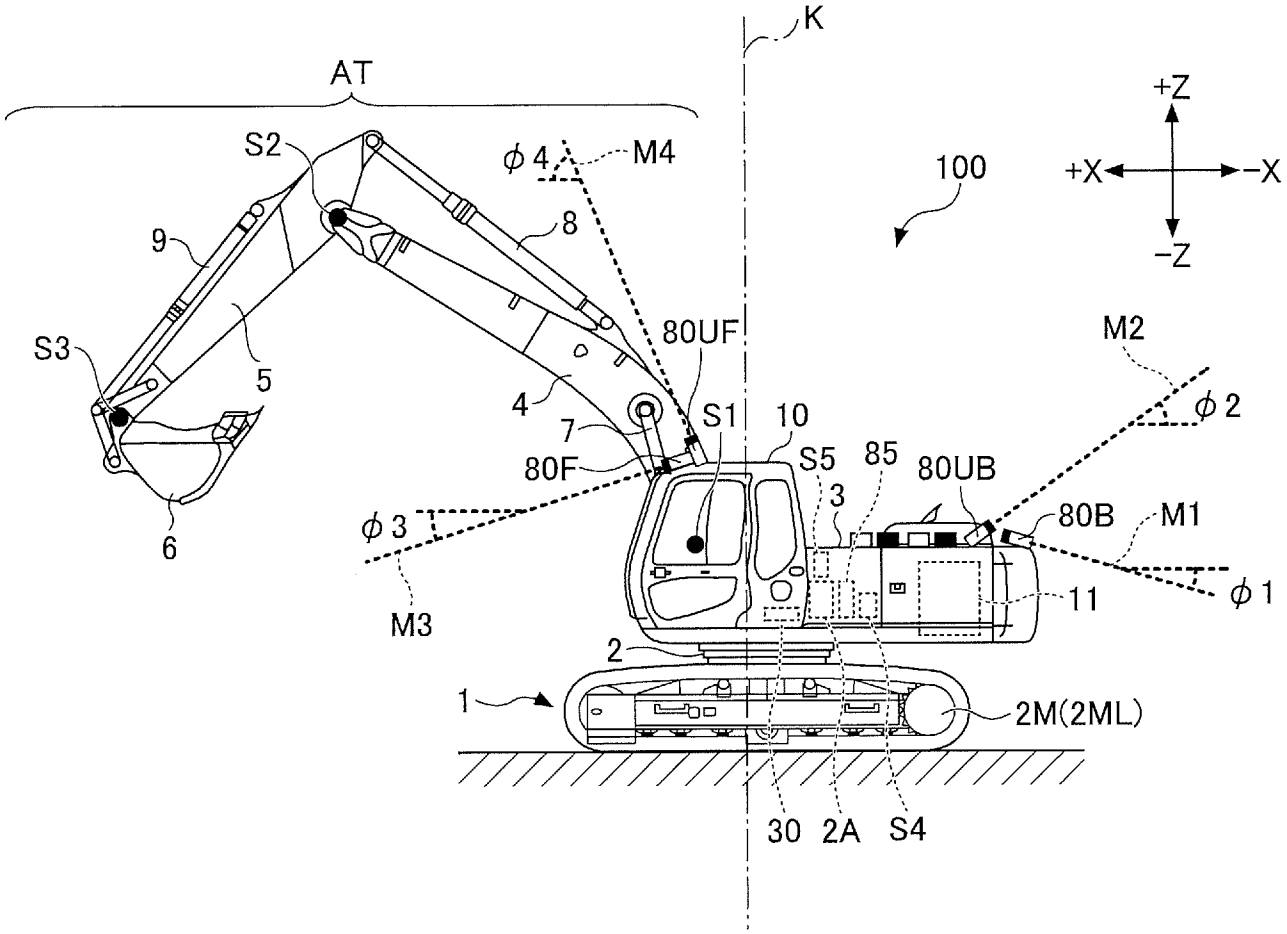
FIG. 17A is a side view of the shovel according to the embodiment of the present invention.
Figure 17B:
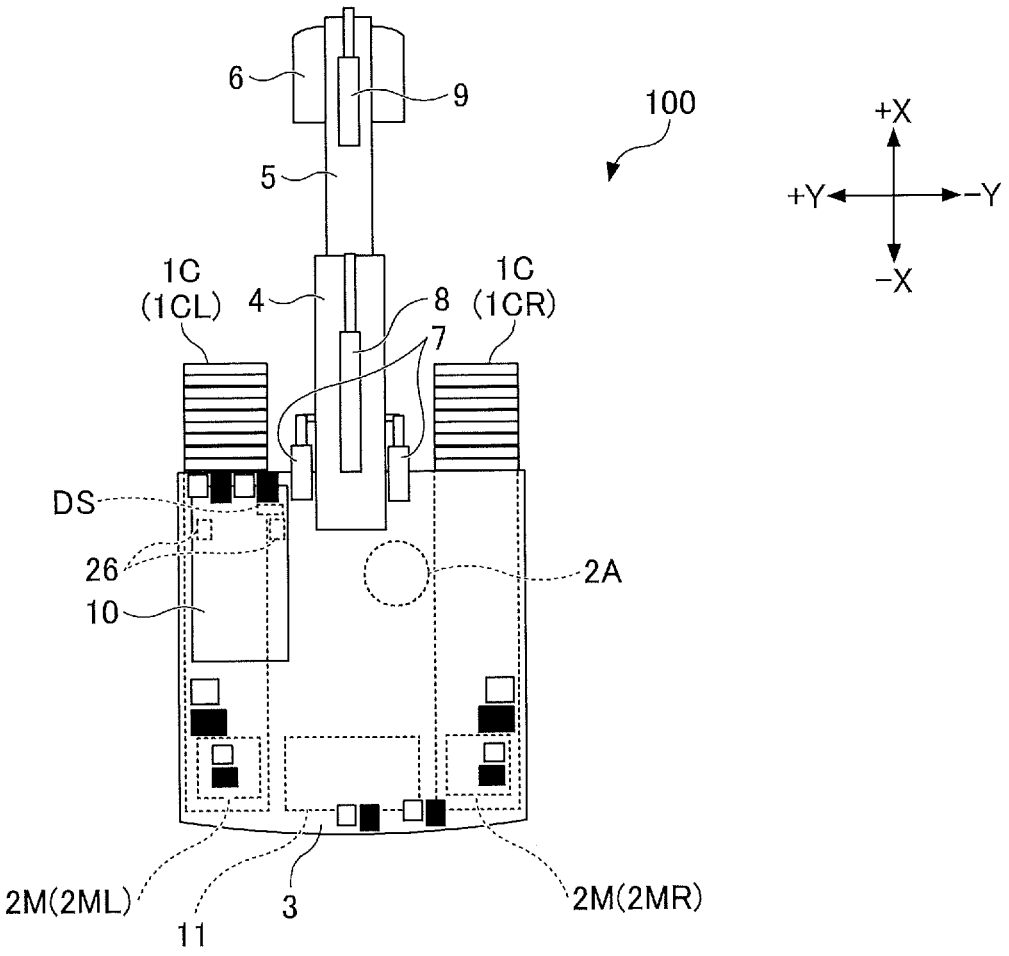
FIG. 17B is a plan view of the shovel according to the embodiment of the present invention.
Figure 17C:
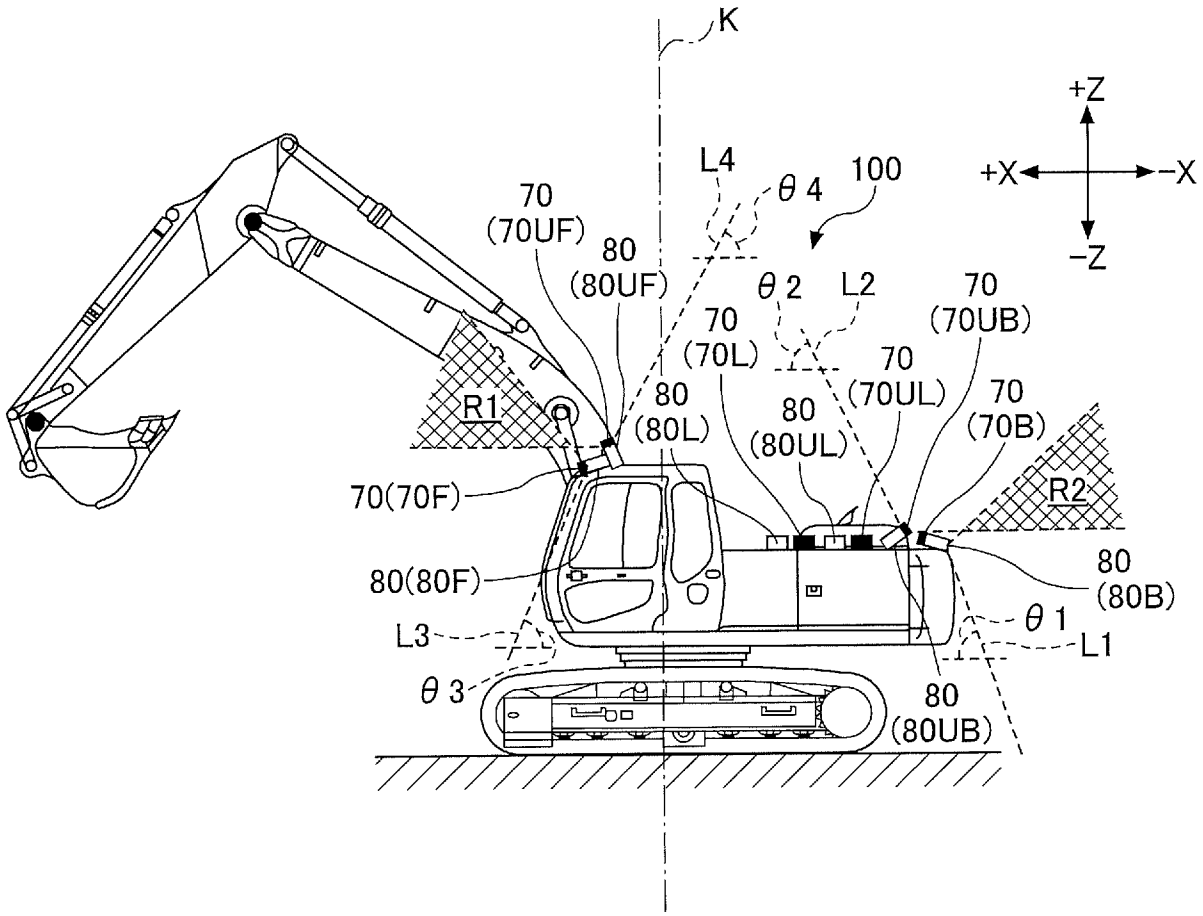
FIG. 17C is a side view of the shovel according to the embodiment of the present invention.
Figure 17D:
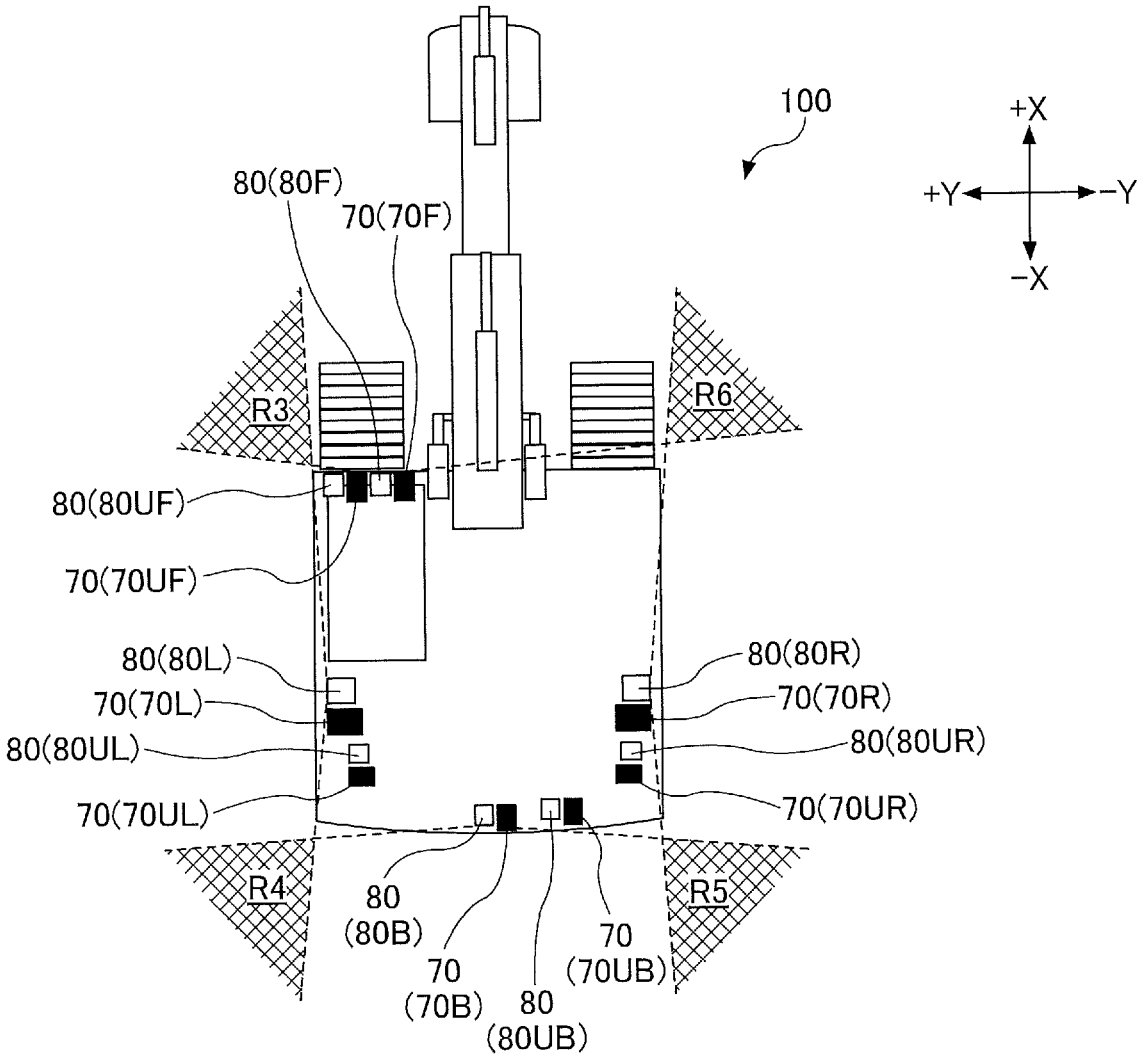
FIG. 17D is a plan view of the shovel according to the embodiment of the present invention.

Next, yet another example configuration of the shovel 100 is described with reference to FIGS. 17A through 17D. FIGS. 17A and 17C are side views of the shovel 100. FIGS. 17B and 17D are plan views of the shovel 100. FIG. 17A is the same drawing as FIG. 17C except for reference numerals and auxiliary lines. FIG. 17B is the same drawing as FIG. 17D except for reference numerals and auxiliary lines.

According to the example of FIGS. 17A through 17D, the object detector 70 is an example of the surroundings monitoring device, and includes the back sensor 70B and an upper back sensor 70UB that are LIDARs attached to the back end of the upper surface of the upper swing structure 3, the front sensor 70F and an upper front sensor 70UF that are LIDARs attached to the front end of the upper surface of the cabin 10, the left sensor 70L and an upper left sensor 70UL that are LIDARs attached to the left end of the upper surface of the upper swing structure 3, and the right sensor 70R and an upper right sensor 70UR that are LIDARs attached to the right end of the upper surface of the upper swing structure 3.

The back sensor 70B is configured to detect an object behind and diagonally below the shovel 100. The upper back sensor 70UB is configured to detect an object behind and diagonally above the shovel 100. The front sensor 70F is configured to detect an object in front of and diagonally below the shovel 100. The upper front sensor 70UF is configured to detect an object in front of and diagonally above the shovel 100. The left sensor 70L is configured to detect an object to the left of and diagonally below the shovel 100. The upper left sensor 70UL is configured to detect an object to the left of and diagonally above the shovel 100. The right sensor 70R is configured to detect an object to the right of and diagonally below the shovel 100. The upper right sensor 70UR is configured to detect an object to the right of and diagonally above the shovel 100.

According to the example of FIGS. 17A through 17D, the image capturing device 80 is another example of the surroundings monitoring device, and includes the back camera 80B and an upper back camera 80UB attached to the back end of the upper surface of the upper swing structure 3, a front camera 80F and an upper front camera 80UF attached to the front end of the upper surface of the cabin 10, the left camera 80L and an upper left camera 80UL attached to the left end of the upper surface of the upper swing structure 3, and the right camera 80R and an upper right camera 80UR attached to the right end of the upper surface of the upper swing structure 3.

The back camera 80B is configured to capture an image of an area behind and diagonally below the shovel 100. The upper back camera 80UB is configured to capture an image of an area behind and diagonally above the shovel 100. The front camera 80F is configured to capture an image of an area in front of and diagonally below the shovel 100. The upper front camera 80UF is configured to capture an image of an area in front of and diagonally above the shovel 100. The left camera 80L is configured to capture an image of an area to the left of and diagonally below the shovel 100. The upper left camera 80UL is configured to capture an image of an area to the left of and diagonally above the shovel 100. The right camera 80R is configured to capture an image of an area to the right of and diagonally below the shovel 100. The upper right camera 80UR is configured to capture an image of an area to the right of and diagonally above the shovel 100.

Specifically, as illustrated in FIG. 17A, the back camera 80B is configured such that a dashed line M1 that is a virtual line representing an optical axis forms an angle (an angle of depression) $\phi$1 to a virtual plane perpendicular to a swing axis K (a virtual horizontal plane in the example of FIG. 17A). The upper back camera 80UB is configured such that a dashed line M2 that is a virtual line representing an optical axis forms an angle (an angle of elevation) $\phi$2 to a virtual plane perpendicular to the swing axis K. The front camera 80F is configured such that a dashed line M3 that is a virtual line representing an optical axis forms an angle (an angle of depression) $\phi$3 to a virtual plane perpendicular to the swing axis K. The upper front camera 80UF is configured such that a dashed line M4 that is a virtual line representing an optical axis forms an angle (an angle of elevation) $\phi$4 to a virtual plane perpendicular to the swing axis K. Although not depicted, the left camera 80L and the right camera 80R are likewise configured such that their respective optical axes form an angle of depression to a virtual plane perpendicular to the swing axis K, and the upper left camera 80UL and the upper right camera 80UR are likewise configured such that their respective optical axes form an angle of elevation to a virtual plane perpendicular to the swing axis K.

In FIG. 17C, an area R1 represents an overlap between the monitoring range (imaging range) of the front camera 80F and the imaging range of the upper front camera 80UF, and an area R2 represents an overlap between the imaging range of the back camera 80B and the imaging range of the upper back camera 80UB. That is, the back camera 80B and the upper back camera 80UB are disposed such that their respective imaging ranges vertically overlap each other, and the front camera 80F and the upper front camera 80UF as well are disposed such that their respective imaging ranges vertically overlap each other. Furthermore, although not depicted, the left camera 80L and the upper left camera 80UL as well are disposed such that their respective imaging ranges vertically overlap each other, and the right camera 80R and the upper right camera 80UR as well are disposed such that their respective imaging ranges vertically overlap each other.

As illustrated in FIG. 17C, the back camera 80B is configured such that a dashed line L1 that is a virtual line representing the lower boundary of the imaging range forms an angle (an angle of depression) θ1 to a virtual plane perpendicular to the swing axis K (a virtual horizontal plane in the example of FIG. 17C). The upper back camera 80UB is configured such that a dashed line L2 that is a virtual line representing the upper boundary of the imaging range forms an angle (an angle of elevation) θ2 to a virtual plane perpendicular to the swing axis K. The front camera 80F is configured such that a dashed line L3 that is a virtual line representing the lower boundary of the imaging range forms an angle (an angle of depression) θ3 to a virtual plane perpendicular to the swing axis K. The upper front camera 80UF is configured such that a dashed line L4 that is a virtual line representing the upper boundary of the imaging range forms an angle (an angle of elevation) θ4 to a virtual plane perpendicular to the swing axis K. The angle (angle of depression) θ1 and the angle (angle of depression) θ3 are desirably 55 degrees or more. According to FIG. 17C, the angle (angle of depression) θ1 is approximately 70 degrees, and the angle (angle of depression) θ3 is approximately 65 degrees. The angle (angle of elevation) θ2 and the angle (angle of elevation) θ4 are desirably 90 degrees or more, more desirably 135 degrees or more, and still more desirably, 180 degrees. According to FIG. 17C, the angle (angle of elevation) θ2 is approximately 115 degrees, and the angle (angle of elevation) θ4 is approximately 115 degrees. Although not depicted, the left camera 80L and the right camera 80R as well are likewise configured such that the lower boundaries of their respective imaging ranges form an angle of depression of 55 degrees or more to a virtual plane perpendicular to the swing axis K, and the upper left camera 80UL and the upper right camera 80UR as well are likewise configured such that the upper boundaries of their respective imaging ranges form an angle of elevation of 90 degrees or more to a virtual plane perpendicular to the swing axis K.

Therefore, the shovel 100 can detect an object present within a space above the cabin 10 with the upper front camera 80UF. Furthermore, the shovel 100 can detect an object within a space above an engine hood with the upper back camera 80UB. Furthermore, the shovel 100 can detect objects present within a space above the upper swing structure 3 with the upper left camera 80UL and the upper right camera 80UR. Thus, the shovel 100 can detect objects present within a space above the shovel 100 with the upper back camera 80UB, the upper front camera 80UF, the upper left camera 80UL, and the upper right camera 80UR.

In FIG. 17D, an area R3 represents an overlap between the imaging range of the front camera 80F and the imaging range of the left camera 80L, an area R4 represents an overlap between the imaging range of the left camera 80L and the back camera 80B, an area R5 represents an overlap between the imaging range of the back camera 80B and the imaging range of the right camera 80R, and an area R6 represents an overlap between the imaging range of the right camera 80R and the imaging range of the front camera 80F. That is, the front camera 80F and the left camera 80L are disposed such that their respective imaging ranges laterally overlap each other. The left camera 80L and the back camera 80B as well are disposed such that that their respective imaging ranges laterally overlap each other. The back camera 80B and the right camera 80R as well are disposed such that that their respective imaging ranges laterally overlap each other. The right camera 80R and the front camera 80F as well are disposed such that that their respective imaging ranges laterally overlap each other. Furthermore, although not depicted, the upper front camera 80UF and the upper left camera 80UL are disposed such that their respective imaging ranges laterally overlap each other. The upper left camera 80UL and the upper back camera 80UB as well are disposed such that that their respective imaging ranges laterally overlap each other. The upper back camera 80UB and the upper right camera 80UR as well are disposed such that that their respective imaging ranges laterally overlap each other. The upper right camera 80UR and the upper front camera 80UF as well are disposed such that that their respective imaging ranges laterally overlap each other.

According to this disposition, the upper front camera 80UF, for example, can capture an image of an object in a space where the distal end of the boom 4 is positioned and its surrounding space when the boom 4 is most raised. Therefore, for example, by using an image captured by the upper front camera 80UF, the controller can prevent the distal end of the boom 4 from contacting an electric wire extending over the shovel 100.

The upper front camera 80UF may be attached to the cabin 10 such that the arm 5 and the bucket 6 are within the imaging range of the upper front camera 80UF even when at least one of the arm 5 and the bucket 6 is pivoted with the boom 4 being most raised in a boom upper limit position. In this case, even when at least one of the arm 5 and the bucket 6 is most opened with the boom upper limit position, the controller 30 can determine whether an excavation attachment AT may contact an object around. The excavation attachment AT is an example of the attachment and is constituted of the boom 4, the arm 5, and the bucket 6.

The object detector 70 as well may be placed the same as the image capturing device 80. That is, the back sensor 70B and the upper back sensor 70UB may be disposed such that their respective monitoring ranges (detection ranges) vertically overlap each other. The front sensor 70F and the upper front sensor 70UF as well may be disposed such that their respective detection ranges vertically overlap each other. The left sensor 70L and the upper left sensor 70UL as well may be disposed such that their respective detection ranges vertically overlap each other. The right sensor 70R and the upper right sensor 70UR as well may be disposed such that their respective detection ranges vertically overlap each other.

The front sensor 70F and the left sensor 70L may be disposed such that their respective detection ranges laterally overlap each other. The left sensor 70L and the back sensor 70B as well may be disposed such that their respective detection ranges laterally overlap each other. The back sensor 70B and the right sensor 70R as well may be disposed such that their respective detection ranges laterally overlap each other. The right sensor 70R and the front sensor 70F as well may be disposed such that their respective detection ranges laterally overlap each other.

The upper front sensor 70UF and the upper left sensor 70UL may be disposed such that their respective detection ranges laterally overlap each other. The upper left sensor 70UL and the upper back sensor 70UB as well may be disposed such that their respective detection ranges laterally overlap each other. The upper back sensor 70UB and the upper right sensor 70UR as well may be disposed such that their respective detection ranges laterally overlap each other. The upper right sensor 70UR and the upper front sensor 70UF as well may be disposed such that their respective detection ranges laterally overlap each other.

The back sensor 70B, the front sensor 70F, the left sensor 70L, and the right sensor 70R may be configured such that their respective optical axes form an angle of depression to a virtual plane perpendicular to the swing axis K. The upper back sensor 70UB, the upper front sensor 70UF, the upper left sensor 70UL, and the upper right sensor 70UR may be configured such that their respective optical axes form an angle of elevation to a virtual plane perpendicular to the swing axis K.

The back sensor 70B, the front sensor 70F, the left sensor 70L, and the right sensor 70R may be configured such that the lower boundaries of their respective detection ranges form an angle of depression to a virtual plane perpendicular to the swing axis K. The upper back sensor 70UB, the upper front sensor 70UF, the upper left sensor 70UL, and the upper right sensor 70UR may be configured such that the upper boundaries of their respective detection ranges form an angle of elevation to a virtual plane perpendicular to the swing axis K.

According to the example of FIGS. 17A through 17D, the back camera 80B is placed next to the back sensor 70B, the front camera 80F is placed next to the front sensor 70F, the left camera 80L is placed next to the left sensor 70L, and the right camera 80R is placed next to the right sensor 70R. Furthermore, the upper back camera 80UB is placed next to the upper back sensor 70UB, the upper front camera 80UF is placed next to the upper front sensor 70UF, the upper left camera 80UL is placed next to the upper left sensor 70UL, and the upper right camera 80UR is placed next to the upper right sensor 70UR.

According to the example of FIGS. 17A through 17D, each of the object detector 70 and the image capturing device 80 is attached to the upper swing structure 3 in such a manner as not to protrude from the outline of the upper swing structure 3 in a plan view as illustrated in FIG. 17D. At least one of the object detector 70 and the image capturing device 80, however, may be attached to the upper swing structure 3 in such a manner as to protrude from the outline of the upper swing structure 3 in a plan view.

The upper back camera 80UB may be omitted or integrated with the back camera 80B. The back camera 80B with which the upper back camera 80UB is integrated may be configured to be able to cover a wider imaging range including the imaging range covered by the upper back camera 80UB. The same is true for the upper front camera 80UF, the upper left camera 80UL, and the upper right camera 80UR. Furthermore, the upper back sensor 70UB may be omitted or integrated with the back sensor 70B. The same is true for the upper front sensor 70UF, the upper left sensor 70UL, and the upper right sensor 70UR. Furthermore, at least two of the upper back camera 80UB, the upper front camera 80UF, the upper left camera 80UL, and the upper right camera 80UR may be integrated into one or more omnidirectional cameras or hemisphere cameras.

The controller 30 may also be configured to recognize their respective overall and three-dimensional outer shapes (outer surfaces) of the shovel 100 and an object when calculating the distance between the shovel 100 and the object based on the output of the object detector 70. The outer surface of the shovel 100 includes, for example, the outer surface of the undercarriage, the outer surface of the upper swing structure 3, and the outer surface of the excavation attachment AT. The positional relationship between the attachment position of a pose sensor and the outer surface of the undercarriage 1, the outer surface of the upper swing structure 3, and the outer surface of the excavation attachment AT is preset in the controller 30. Therefore, the controller 30 can calculate changes in the positions of the outer surface of the undercarriage 1, the outer surface of the upper swing structure 3, and the outer surface of the excavation attachment AT by calculating a change in the position of the pose sensor at predetermined intervals.

Specifically, for example, using a virtual three-dimensional model such as a polygon model, a wire frame model or the like, the controller 30 recognizes the overall and three-dimensional outer shape (outer surface) of the shovel 100 and calculate the coordinates of points in the outer surface. The outer surface of the undercarriage 1 includes, for example, the front surface, upper surface, bottom surface, back surface, etc., of the crawler 1C. The outer surface of the upper swing structure 3 includes, for example, the surface of a side cover, the upper surface of the engine hood, and the upper surface, left side surface, right side surface, back surface, etc., of the counterweight. The outer surface of the excavation attachment AT includes, for example, the rear surface, left side surface, right side surface, and front surface of the boom 4 and the rear surface, left side surface, right side surface, and front surface of the arm 5.

Figure 18A:
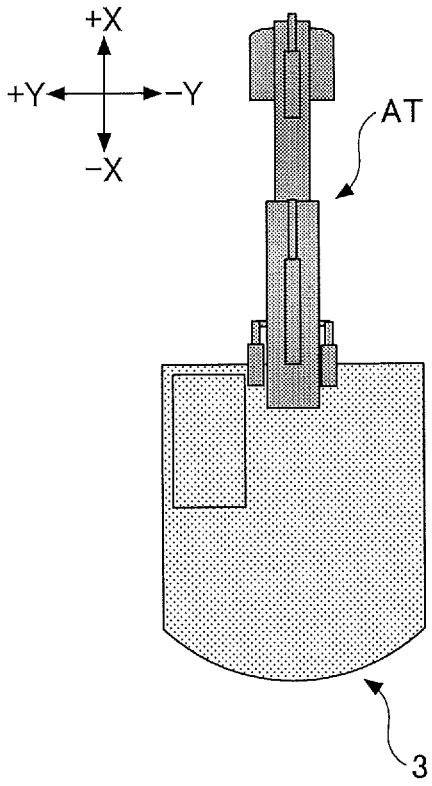
FIGS. 18A through 18C are diagrams illustrating an example configuration of the outer surface of the shovel.
Figure 18B:
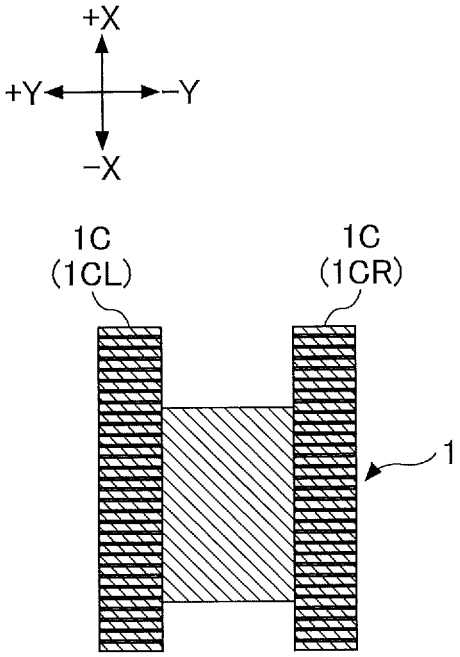
Figure 18C:
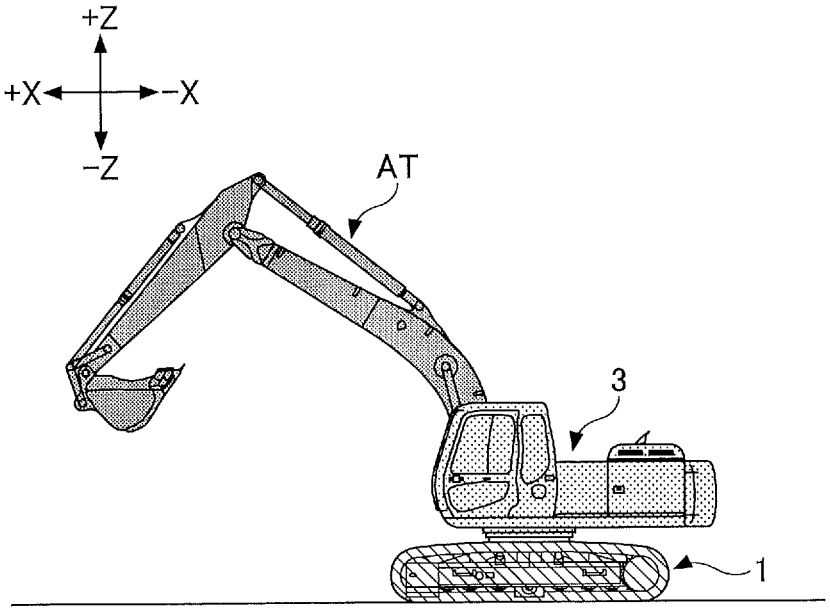

FIGS. 18A through 18C illustrate an example configuration of the overall and three-dimensional outer surface of the shovel 100 recognized using a polygon model. FIG. 18A is a plan view of a polygon mode of the upper swing structure 3 and the excavation attachment AT. FIG. 18B is a plan view of a polygon model of the undercarriage 1. FIG. 18C is a left side view of a polygon model of the shovel 100. In FIGS. 18A through 18C, the outer surface of the undercarriage 1 is represented by an oblique line pattern, the outer surface of the upper swing structure 3 is represented by a rough dot pattern, and the outer surface of the excavation attachment AT is represented by a fine dot pattern.

The outer surface of the shovel 100 as a polygon model may be recognized as a surface outward of the actual outside surface of the shovel 100 by a predetermined marginal distance. That is, the shovel 100 as a polygon model may be recognized as, for example, the respective independent similar enlargements of the actual undercarriage 1, upper swing structure 3, and excavation attachment AT. In this case, the marginal distance may be a distance that varies according to the movement of the shovel 100 (for example, the movement of the excavation attachment AT). The controller 30 may output an alarm or brake the movement of a driven body through the above-described automatic braking process or the like, in response to determining that there has been a contact or there may be a contact between this similar enlarged polygon model and the polygon model of an object detected by the object detector 70.

The controller 30, for example, may determine whether part of the machine body may contact an object independently with respect to each of the three parts constituting the outer surface of the shovel 100 (the outer surface of the undercarriage 1, the outer surface of the upper swing structure 3, and the outer surface of the excavation attachment AT). Furthermore, the controller 30 may omit a determination as to whether part of the machine body may contact an object with respect to at least one of the three parts, depending on the work details of the shovel 100.

For example, according to the example illustrated in FIGS. 10A through 10D, the controller 30 may calculate the distance between the object OB and each point in the outer surface of the excavation attachment AT at predetermined control intervals. In this case, the controller 30 may omit calculation of the distance between the object OB and each point in the outer surface of the undercarriage 1 and each point in the outer surface of the upper swing structure 3.

The controller 30 may also be configured to, in a work site where the shovel 100 may contact an electric wire above the shovel 100, calculate the distance between the electric wire and each point in the outer surface of the excavation attachment AT (for example, each point in the outer surface of the distal end of the boom 4) at predetermined control intervals. In this case, the controller 30 may omit calculation of the distance between the electric wire and each point in the outer surface of the undercarriage 1 and each point in the outer surface of the upper swing structure 3.

The controller 30 may also be configured to, in a work site where the shovel 100 may contact an object behind or to the side of the shovel 100, calculate the distance between the object and each point in the outer surface of the upper swing structure 3 (for example, each point in the outer surface of the counterweight) at predetermined control intervals. In this case, the controller 30 may omit calculation of the distance between the object and each point in the outer surface of the undercarriage 1 and each point in the outer surface of the excavation attachment AT.

The controller 30 may also be configured to, in a work site where the shovel 100 may contact an object lower than the crawler 1C that is near the crawler 1C, calculate the distance between the object and each point in the outer surface of the undercarriage 1 (for example, each point in the outer surface of the crawler 1C) at predetermined control intervals. In this case, the controller 30 may omit calculation of the distance between the object and each point in the outer surface of the upper swing structure 3 and each point in the outer surface of the excavation attachment AT.

Figure 19:
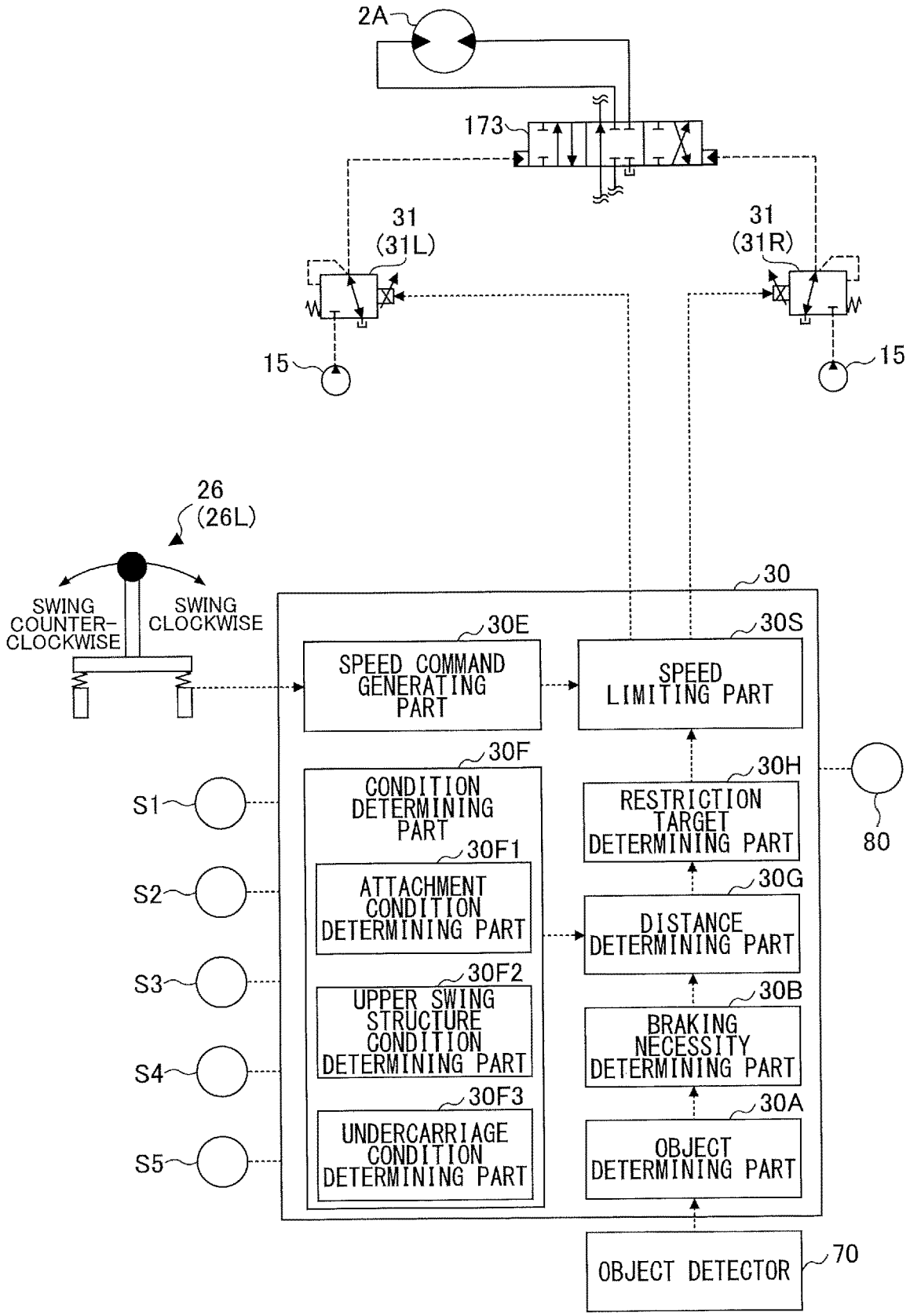
FIG. 19 is a diagram illustrating an example configuration of a controller.

Here, an example of the function of restricting the movement of a driven body based on the distance between an object detected by the object detector 70 serving as the surroundings monitoring device and each of the three parts constituting the outer surface of the shovel 100 is described with reference to FIG. 19. FIG. 19 is a diagram illustrating an example configuration of the controller 30. The surroundings monitoring device may also be the image capturing device 80.

According to the example illustrated in FIG. 19, the controller 30 includes, as functional elements, an object determining part 30A, a braking necessity determining part 30B, a speed command generating part 30E, a condition determining part 30F, a distance determining part 30G, a restriction target determining part 30H, and a speed limiting part 30S. The controller 30 is configured to be able to receive the output signals of the boom angle sensor S1, the arm angle sensor S2, the bucket angle sensor S3, the body tilt sensor S4, the swing angular velocity sensor S5, the electric left operating lever 26L, the object detector 70, the image capturing device 80, etc., execute various operations, and output a control command to a proportional valve 31, etc.

The proportional valve 31 is configured to operate in response to a current command output by the controller 30. The proportional valve 31 includes a left proportional valve 31L and a right proportional valve 31R. Specifically, the left proportional valve 31L is configured to be able to adjust a pilot pressure generated by hydraulic oil introduced to the left pilot port of the control valve 173 from the pilot pump 15 via the left proportional valve 31L. Likewise, the right proportional valve 31R is configured to be able to adjust a pilot pressure generated by hydraulic oil introduced to the right pilot port of the control valve 173 from the pilot pump 15 via the right proportional valve 31R. The proportional valve 31 can adjust the pilot pressure such that the control valve 173 can stop at any valve position. FIG. 19 illustrates, by way of example, a configuration associated with the control valve 173 that controls the flow rate of hydraulic oil supplied to the swing hydraulic motor 2A. The controller 30 can control the flow rate of hydraulic oil supplied to each of the travel hydraulic motor 2M, the boom cylinder 7, the arm cylinder 8, and the bucket cylinder 9 with the same configuration.

The object determining part 30A is configured to determine the type of an object. According to the example illustrated in FIG. 19, the object determining part 30A is configured to determine the type of an object detected by the object detector 70.

The braking necessity determining part 30B is configured to determine the necessity of braking according to the type of an object. According to the example illustrated in FIG. 19, the braking necessity determining part 30B is configured to determine that it is necessary to brake a driven body when it is determined that the object detected by the object detector 70 is a person.

The speed command generating part 30E is configured to generate a command with respect to the operating speed of an actuator based on the output signal of the operating device 26. According to the example illustrated in FIG. 19, the speed command generating part 30E is configured to generate a command with respect to the rotational speed of the swing hydraulic motor 2A based on an electrical signal output by the left operating lever 26L operated rightward or leftward.

The condition determining part 30F is configured to determine the current condition of the shovel 100. Specifically, the condition determining part 30F includes an attachment condition determining part 30F1, an upper swing structure condition determining part 30F2, and an undercarriage condition determining part 30F3.

The attachment condition determining part 30F1 is configured to determine the current condition of the excavation attachment AT. Specifically, the attachment condition determining part 30F1 is configured to calculate the coordinates of predetermined points in the outer surface of the excavation attachment AT. The predetermined points include, for example, all vertices of the excavation attachment AT.

The upper swing structure condition determining part 3052 is configured to determine the current condition of the upper swing structure 3. Specifically, the upper swing structure condition determining part 3052 is configured to calculate the coordinates of predetermined points in the outer Surface of the upper swing structure 3. The predetermined points include, for example, all vertices of the upper swing structure 3.

The undercarriage condition determining part 30F3 is configured to determine the current condition of the undercarriage 1. Specifically, the undercarriage condition determining part 30F3 is configured to calculate the coordinates of predetermined points in the outer surface of the undercarriage 1. The predetermined points include, for example, all vertices of the undercarriage 1.

The condition determining part 30F may determine, according to the work details of the shovel 100, with respect to which of the three parts constituting the outer surface of the shovel 100 (the outer surface of the undercarriage 1, the outer surface of the upper swing structure 3, and the outer surface of the excavation attachment AT) a determination as to the condition is to be performed and is to be omitted.

The distance determining part 30G is configured to determine whether the distance between each point in the outer surface of the shovel 100 calculated by the condition determining part 30F and an object detected by the object detector 70 is less than a predetermined value. According to the example illustrated in FIG. 19, the distance determining part 30G calculates the distance between each point in the outer surface of the shovel 100 calculated by the condition determining part 30F and an object detected by the object detector 70 when the braking necessity determining part 30B determines that it is necessary to brake a driven body.

The restriction target determining part 30H is configured to determine a restriction target. According to the example illustrated in FIG. 19, the restriction target determining part 30H determines an actuator whose movement is to be restricted (hereinafter "restriction target actuator") based on the output of the distance determining part 30G, namely, to which point in the outer surface of the shovel 100 the distance from the object is less than a predetermined value.

The speed limiting part 30S is configured to limit the operating speed of one or more actuators. According to the example illustrated in FIG. 19, the speed limiting part 30S changes a speed command with respect to an actuator determined as the restriction target actuator by the restriction target determining part 30H among speed commands generated by the speed command generating part 30E, and outputs a control command corresponding to the changed speed command to the proportional valve 31.

Specifically, the speed limiting part 30S changes a speed command with respect to the swing hydraulic motor 2A determined as the restriction target actuator by the restriction target determining part 30H, and outputs a control command corresponding to the changed speed command to the proportional valve 31, in order to reduce the rotational speed of the swing hydraulic motor 2A or to stop the rotation of the swing hydraulic motor 2A.

More specifically, the speed limiting part 30S is configured to restrict the operating speed of one or more actuators using braking patters as illustrated in each of FIGS. 6, 8, 11 and 13.

The speed limiting part 30S, for example, may change braking patterns according to the weight of an excavated object such as earth loaded into the bucket 6 and the pose of the excavation attachment AT. In this case, the weight of the excavated object is, for example, calculated based on the pose of the excavation attachment AT and the pressure of hydraulic oil in the boom cylinder 7. The weight of the excavated object may be calculated based on the pose of the excavation attachment AT and at least one of the pressure of hydraulic oil in the boom cylinder 7, the pressure of hydraulic oil in the arm cylinder 8, and the pressure of hydraulic oil in the bucket cylinder 9.

With the speed limiting part 30S, the controller 30 illustrated in FIG. 19 can decelerate or stop the movement of an actuator to prevent part of the machine body of the shovel 100 from contacting an object.

Figure 20:
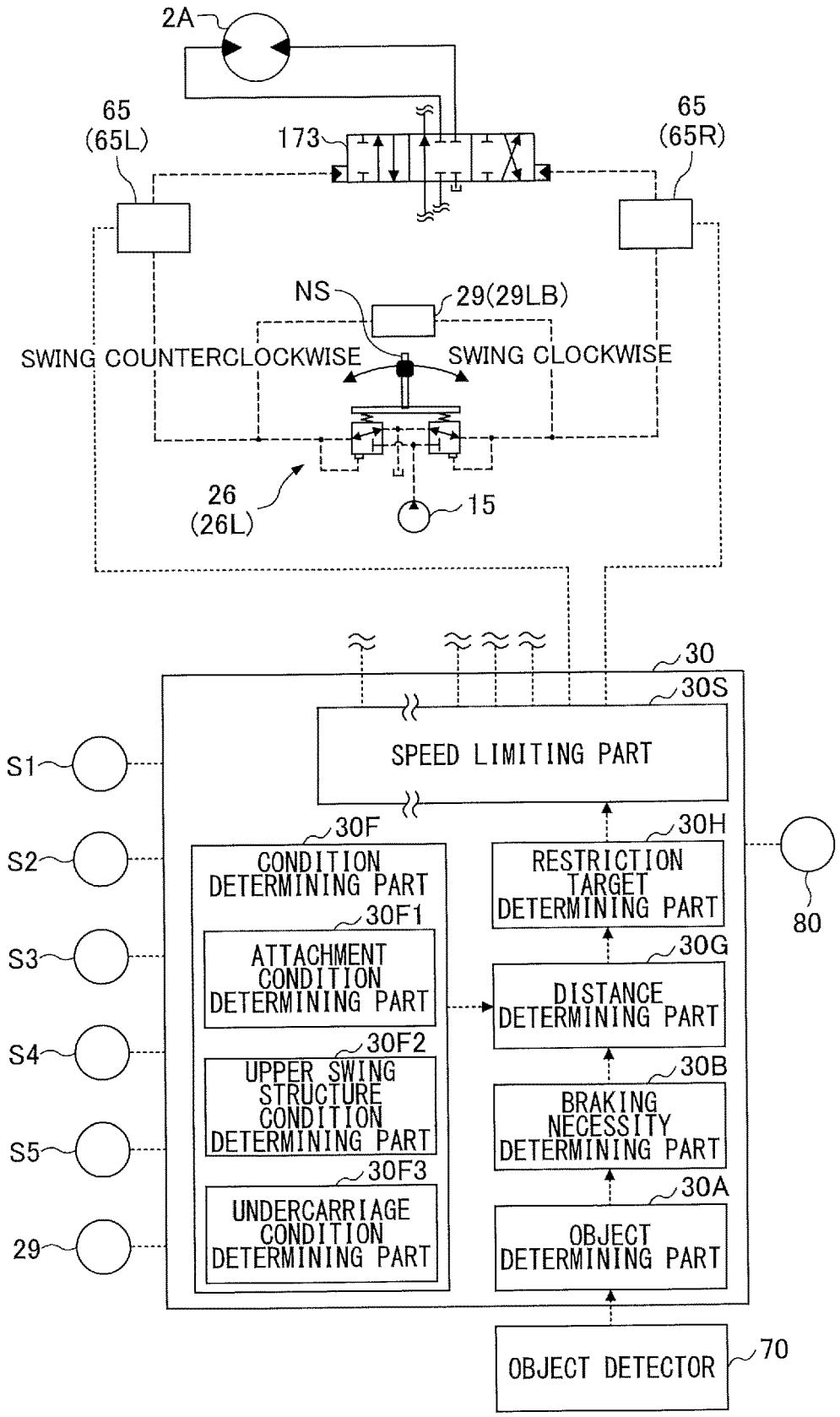
FIG. 20 is a diagram illustrating another example configuration of the controller.

Next, another example of the function of restricting the movement of a driven body based on the distance between an object detected by the object detector 70 serving as the surroundings monitoring device and each of the three parts constituting the outer surface of the shovel 100 is described with reference to FIG. 20. FIG. 20 is a diagram illustrating another example configuration of the controller 30. The surroundings monitoring device may also be the image capturing device 80.

The controller 30 illustrated in FIG. 20 is different in being connected to a hydraulic operating lever with a hydraulic pilot circuit from the controller 30 illustrated in FIG. 19, which is connected to an electric operating lever with a hydraulic pilot circuit. Specifically, the speed limiting part 30S of the controller 30 illustrated in FIG. 20 generates a speed command based on the output of the operating pressure sensor 29, changes a speed command with respect to an actuator determined as the restriction target actuator by the restriction target determining part 30H among generated speed commands, and outputs a control command corresponding to the changed speed command to a solenoid valve 65 associated with the actuator.

The solenoid valve 65 includes a solenoid valve 65L and a solenoid valve 65R. According to the example illustrated in FIG. 20, the solenoid valve 65L is a solenoid proportional valve placed in a conduit connecting the left port of a remote control valve that discharges hydraulic oil when the left operating lever 26L is operated rightward or leftward and the left pilot port of the control valve 173. The solenoid valve 65R is a solenoid proportional valve placed in a conduit connecting the right port of the remote control valve that discharges hydraulic oil when the left operating lever 26L is operated rightward or leftward and the right pilot port of the control valve 173.

Specifically, the speed limiting part 30S changes a speed command with respect to the swing hydraulic motor 2A determined as the restriction target actuator by the restriction target determining part 30H, and outputs a control command corresponding to the changed speed command to the solenoid valve 65, in order to reduce the rotational speed of the swing hydraulic motor 2A or to stop the rotation of the swing hydraulic motor 2A.

With the speed limiting part 30S, the controller 30 illustrated in FIG. 20 can decelerate or stop the movement of an actuator to prevent part of the machine body of the shovel 100 from contacting an object, the same as the controller 30 illustrated in FIG. 19.

An embodiment of the present invention is described in detail above. The present invention, however, is not limited to the above-described embodiment. Various variations, substitutions, or the like may be applied to the above-described embodiment without departing from the scope of the present invention. Furthermore, the separately described features may be suitably combined as long as no technical contradiction is caused.

For example, according to the above-described embodiment, a hydraulic operation system with a hydraulic pilot circuit is disclosed. For example, according to a hydraulic pilot circuit associated with the left operating lever 26L, as illustrated in FIG. 20, hydraulic oil supplied from the pilot pump 15 to the left operating lever 26L is transmitted to a pilot port of the control valve 173 at a flow rate commensurate with the degree of opening of the remote control valve that is opened or closed by the rightward or leftward tilt of the left operating lever 26L. According to a hydraulic pilot circuit associated with the right operating lever 26R, hydraulic oil supplied from the pilot pump 15 to the right operating lever 26R is transmitted to a pilot port of the control valve 175 at a flow rate commensurate with the degree of opening of a remote control valve that is opened or closed by the forward or backward tilt of the right operating lever 26R.

Instead of such a hydraulic operation system with a hydraulic pilot circuit, an electric operating lever as illustrated in FIG. 19 may be adopted. In this case, the amount of lever operation of the electric operating lever is input to the controller 30 as an electrical signal, for example. According to this configuration, when a manual operation using the electric operating lever is performed, the controller 30 can move each control valve by increasing or decreasing a pilot pressure by controlling the solenoid valve with the electrical signal commensurate with the amount of lever operation.

According to the hydraulic system illustrated in FIG. 15, by placing the control valves 60A through 60F between the pilot pump 15 and remote control valves corresponding to individual operating devices 26, a spool valve associated with an actuator to be braked can be moved according to a predetermined braking pattern to smoothly decelerate or stop the actuator. The hydraulic system, however, may alternatively be configured such that the control valves 60A through 60F are placed between the remote control valves corresponding to individual operating devices 26 and the control valves 171 through 176. For example, the control valve 60A may be provided between the remote control valve of the left operating lever 26L and the control valve 176. According to this configuration as well, by moving a spool valve associated with an actuator to be braked according to a predetermined braking pattern, the controller 30 can smoothly decelerate or stop the actuator.

Figure 21:
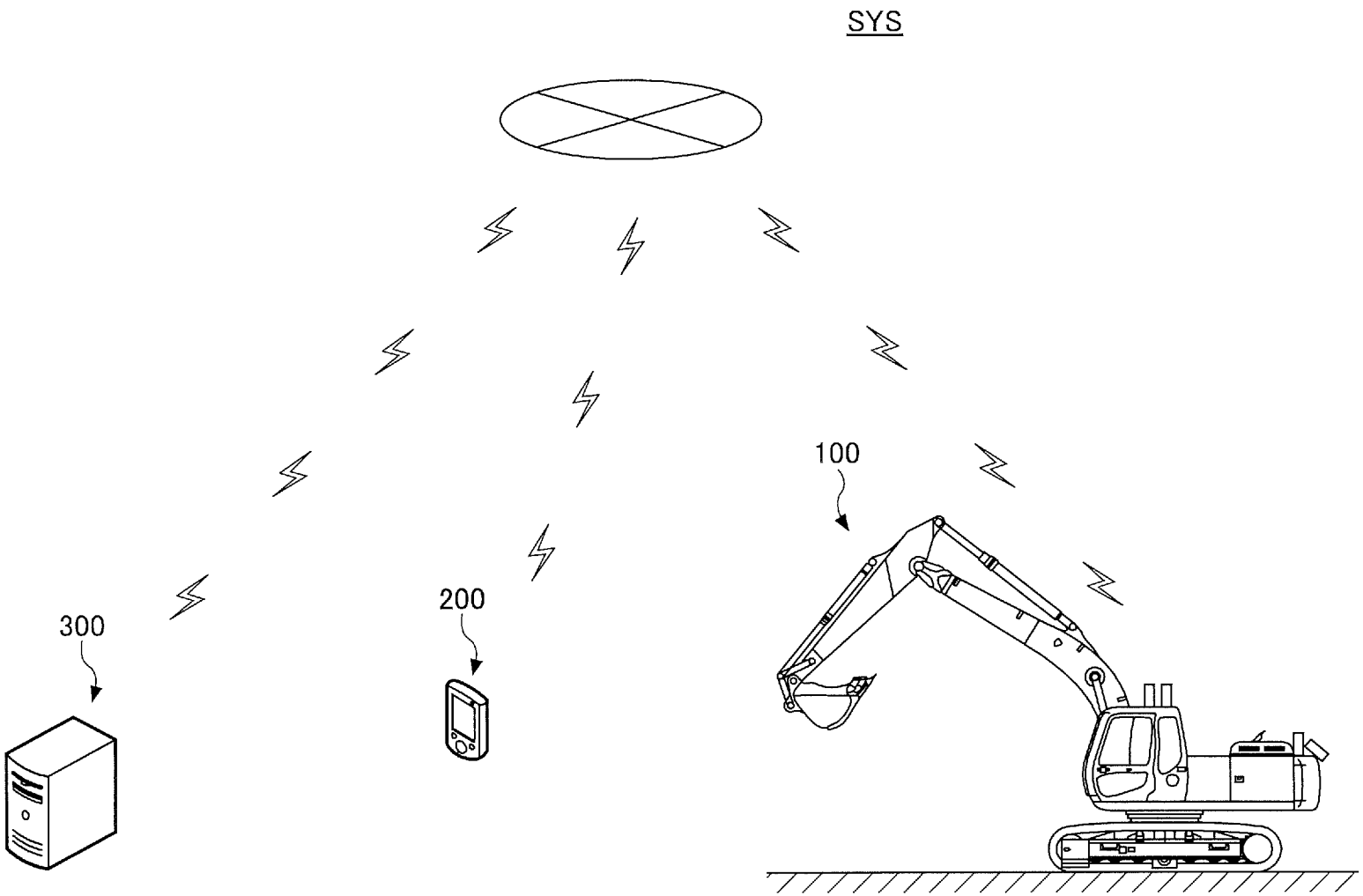
FIG. 21 is a schematic diagram illustrating an example configuration of a shovel management system.

Furthermore, information obtained by the shovel 100 may be shared with a manager, operators of other shovels, etc., through a shovel management system SYS as illustrated in FIG. 21. FIG. 21 is a schematic diagram illustrating an example configuration of the shovel management system SYS. The management system SYS is a system that manages the shovel 100. According to this embodiment, the management system SYS is constituted mainly of the shovel 100, an assist device 200, and a management apparatus 300. The shovel 100, the assist device 200, and the management apparatus 300 each include a communications device, and are directly or indirectly interconnected via a cellular phone network, a satellite communications network, a short-range radio communications network or the like. Each of the shovel 100, the assist device 200, and the management apparatus 300 constituting the management system SYS may be one or more in number. According to the example of FIG. 21, the management system SYS includes the single shovel 100, the single assist device 200, and the single management apparatus 300.

The assist device 200 is typically a portable terminal device, and is, for example, a computer such as a notebook PC, a tablet PC, or a smartphone carried by a worker or the like at a construction site. The assist device 200 may also be a computer carried by the operator of the shovel 100. The assist device 200, however, may also be a stationary terminal device.

The management apparatus 300 is typically a stationary terminal device, and is, for example, a server computer installed in a management center or the like outside a construction site. The management apparatus 300 may also be a portable computer (for example, a portable terminal device such as a notebook PC, a tablet PC, or a smartphone).

At least one of the assist device 200 and the management apparatus 300 (hereinafter, "assist device 200, etc.") may include a monitor and an operating device for remote control. In this case, the operator operates the shovel 100 using the operating device for remote control. The operating device for remote control is connected to the controller 30 through, for example, a communications network such as a cellular phone network, a satellite communications network, or a short-range radio communications network.

According to the shovel management system SYS as described above, the controller 30 of the shovel 100, for example, may transmit information on the automatic braking process to the assist device 200, etc. The information on the automatic braking process includes, for example, at least one of information on the time of starting to brake a driven body (hereinafter "braking start time"), information on the position of the shovel at the braking start time, information on the work details of the shovel 100 at the braking start time, information on a work environment at the braking start time, and information on the movement of the shovel 100 measured at the braking start time and during a period before and after it. The information on a work environment includes, for example, at least one of information on ground inclination, information on weather, etc. The information on the movement of the shovel 100 includes, for example, a pilot pressure, the pressure of hydraulic oil in a hydraulic actuator, etc.

The controller 30 may transmit images captured by the image capturing device 80 to the assist device 200, etc. The images may be, for example, multiple images that are captured during a predetermined period including the braking start time. The predetermined period may include a period preceding the braking start time.

Furthermore, the controller 30 may transmit at least one of information on the work details of the shovel 100, information on the pose of the shovel 100, information on the pose of the excavation attachment, etc., during a predetermined period including the braking start time to the assist device 200, etc. This is for enabling a manager using the assist device 200, etc., to obtain information on a work site. That is, this is for enabling the manager to analyze the cause of the occurrence of a situation where the movement of the shovel 100 has to be decelerated or stopped, and further for enabling the manager to improve the work environment of the shovel 100 based on the results of the analysis.

What is claimed is:

1. A shovel comprising:

an undercarriage;

an upper swing structure swingably mounted on the undercarriage;

an object detector provided on the upper swing structure;

a body tilt sensor configured to detect an inclination of the shovel; and a hardware processor configured to automatically brake a drive part of the shovel according to a predetermined braking pattern, in accordance with a distance between the shovel and an object, the distance being detected by the object detector, wherein the hardware processor has a plurality of braking patterns that are according to the distance between the shovel and the object, the distance being detected by the object detector, and the hardware processor is configured to switch the braking pattern based on an output of the body tilt sensor.

2. The shovel as claimed in claim 1, wherein the plurality of braking patterns differ from each other in timing of starting braking.

3. The shovel as claimed in claim 1, wherein the plurality of braking patterns differ from each other in a rate of increase of a braking force with respect to time elapsed since a start of braking.

4. The shovel as claimed in claim 1, wherein the braking pattern is a braking pattern for an actuator for traveling.

5. The shovel as claimed in claim 1, wherein the braking pattern is a braking pattern for an actuator for swinging.

6. The shovel as claimed in claim 1, wherein the hardware processor is configured to automatically brake the drive part by controlling a solenoid valve according to the predetermined braking pattern, and the solenoid valve is provided between a hydraulic pump and a control valve.

7. The shovel as claimed in claim 6, wherein the hardware processor is configured to automatically brake the drive part by returning the control valve to, a neutral valve position.

8. The shovel as claimed in claim 1, wherein the hardware processor is configured to automatically brake the drive part by disabling an operating device.

9. The shovel as claimed in claim 1, wherein the hardware processor is configured to automatically brake the drive part according to the predetermined braking pattern, in accordance with the distance between the shovel and the object, the distance being detected by the object detector, while an operating device corresponding to the drive part is being operated.

10. The shovel as claimed in claim 1, wherein the hardware processor is configured to automatically brake the drive part by causing a condition of the shovel to be a condition at a time when a gate lock lever is pushed down.

11. A shovel comprising:

an undercarriage;

an upper swing structure swingablv mounted on the undercarriage;

an object detector provided on the upper swing structure; and a hardware processor configured to automatically brake a drive part of the shovel according to a predetermined braking pattern, in accordance with a distance between the shovel and an object, the distance being detected by the object detector, wherein the braking pattern is a braking pattern for an actuator for swinging, and the distance is a length of an arc between an end attachment and the object in a swing circle drawn by the end attachment during a swing motion.

12. The shovel as claimed in claim 5, wherein the hardware processor is configured to automatically brake the drive part according to one of a plurality of braking patterns that are according to a swing moment.

13. A shovel comprising:

an undercarriage;

an upper swing structure swingably mounted on the undercarriage;

an object detector provided on the upper swing structure; and a hardware processor configured to automatically brake a drive part of the shovel according to a predetermined braking pattern, in accordance with a distance between the shovel and an object, the distance being detected by the object detector, wherein the hardware processor is configured to automatically brake the drive part by controlling a solenoid valve according to the predetermined braking pattern, the solenoid valve is provided between a hydraulic pump and a control valve, the control valve is a spool valve, and the solenoid valve is configured to control a movement of the spool valve.

* * * * *